US008641791B2

(12) United States Patent
Thompson

(10) Patent No.: US 8,641,791 B2
(45) Date of Patent: Feb. 4, 2014

(54) METHOD OF SUPPLYING IRON TO THE PARTICULATE TRAP OF A DIESEL ENGINE EXHAUST

(75) Inventor: Russell M. Thompson, Witney (GB)

(73) Assignee: Infineum International Limited, Abingdon, Oxfordshire (GB)

( * ) Notice: Subject to any disclaimer, the term of this patent is extended or adjusted under 35 U.S.C. 154(b) by 521 days.

(21) Appl. No.: 12/593,084

(22) PCT Filed: Mar. 7, 2008

(86) PCT No.: PCT/EP2008/001824

§ 371 (c)(1),
(2), (4) Date: Oct. 14, 2009

(87) PCT Pub. No.: WO2008/116550

PCT Pub. Date: Oct. 2, 2008

(65) Prior Publication Data

US 2010/0101211 A1 Apr. 29, 2010

(30) Foreign Application Priority Data

Mar. 28, 2007 (GB) ..... 0705920.7

(51) Int. Cl.

| | |
|---|---|
| ***B01D 50/00*** | (2006.01) |
| ***B01D 39/14*** | (2006.01) |
| ***B01D 39/06*** | (2006.01) |
| ***B01D 24/00*** | (2006.01) |
| ***F01N 3/00*** | (2006.01) |
| ***C10L 1/12*** | (2006.01) |
| ***C10L 1/18*** | (2006.01) |
| ***C10L 1/30*** | (2006.01) |

(52) U.S. Cl.

USPC ..... 55/282.3; 55/522; 55/523; 55/524; 422/169; 422/170; 422/171; 422/172; 422/177; 422/178; 422/179; 422/180; 422/181; 422/182; 60/274; 44/354; 44/355; 44/356; 44/357; 44/358; 44/359; 44/360; 44/361; 44/362; 44/363

(58) Field of Classification Search

USPC ..... 55/522–524, 282.3; 422/177–182, 422/169–172; 44/354–363; 60/274

See application file for complete search history.

(56) References Cited

U.S. PATENT DOCUMENTS 2,671,758 A * 3/1954 Vinograd et al. ..... 508/154
7,452,388 B2 * 11/2008 Cook et al. ..... 44/361

(Continued)

FOREIGN PATENT DOCUMENTS

EP 1277827 1/2003
EP 1344809 9/2003

(Continued)

OTHER PUBLICATIONS

Leedham et al., Impact of Fuel Additives on Diesel INjector Deposits, Oct. 2004, SAE International.*

Breakspear et al., *Detergency Requirements of Future Diesel Injection Systems*, 2005-01-3901, SAE International.

(Continued)

*Primary Examiner* — Amber Orlando

(74) *Attorney, Agent, or Firm* — Kenyon and Kenyon LLP

(57) ABSTRACT

The invention concerns a method for supplying iron, via the fuel, to the particulate trap of a diesel engine exhaust in a form suitable for promoting trap regeneration. The method involves the addition to the fuel of a defined colloid of iron oxide. Combustion of this colloid produces iron-containing compounds, especially iron oxides, which collect in association with carbonaceous particulate matter in the particulate trap, and function to promote the combustion of this matter. The colloid in particular shows a lower level of associated deposit formation on the fuel injectors than the iron additives of the prior art. The method is thus particularly suitable for modern engines showing increased susceptibility to fuel injector deposits. The colloid also shows a balance of properties providing excellent suitability for use as an additive in fuels, and especially in diesel engine on-board dosing devices.

16 Claims, 5 Drawing Sheets

(56) References Cited

U.S. PATENT DOCUMENTS

Figure 1:
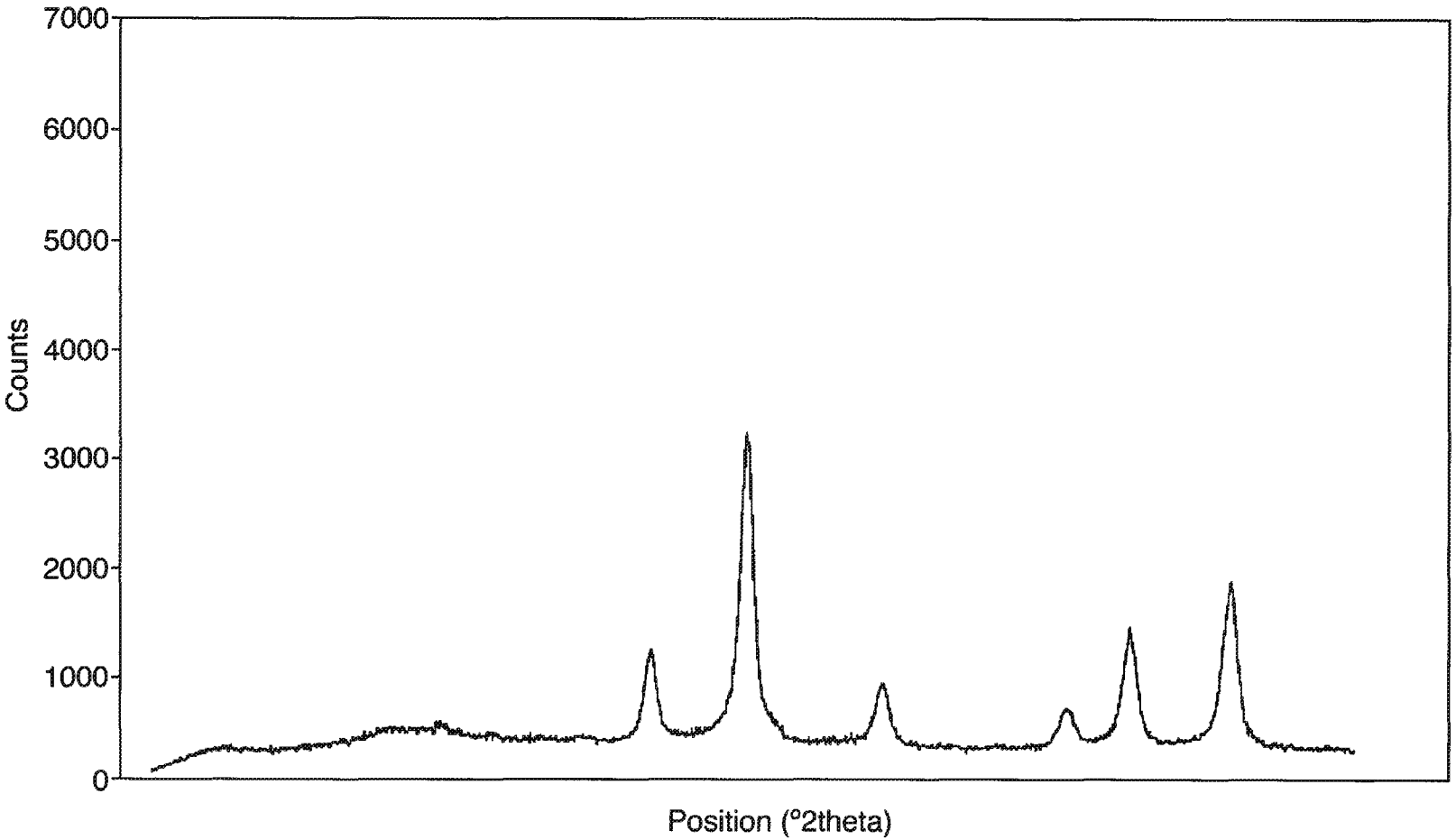

| | | | | |
|---|---|---|---|---|
| 7,459,484 | B2 | 12/2008 | Blanchard et al. | |
| 7,758,660 | B2 * | 7/2010 | Zhou et al. | 44/354 |
| 2003/0182848 | A1 * | 10/2003 | Collier et al. | 44/358 |
| 2003/0187077 | A1 * | 10/2003 | Chane-Ching | 516/31 |
| 2003/0188474 | A1 * | 10/2003 | Cook et al. | 44/349 |
| 2005/0011187 | A1 * | 1/2005 | Cook et al. | 60/311 |
| 2005/0060929 | A1 * | 3/2005 | Caprotti et al. | 44/354 |
| 2006/0000140 | A1 * | 1/2006 | Caprotti et al. | 44/354 |
| 2006/0144039 | A1 * | 7/2006 | Rigaudeau | 60/295 |
| 2006/0230672 | A1 * | 10/2006 | Collier et al. | 44/354 |
| 2006/0248789 | A1 * | 11/2006 | Caprotti et al. | 44/363 |
| 2006/0254130 | A1 | 11/2006 | Scattergood | |
| 2007/0180760 | A1 * | 8/2007 | Zhou et al. | 44/354 |
| 2008/0066375 | A1 * | 3/2008 | Roos et al. | 44/324 |
| 2009/0217570 | A1 * | 9/2009 | Hobson et al. | 44/370 |

FOREIGN PATENT DOCUMENTS

| | | | |
|---|---|---|---|
| EP | 1344814 | | 9/2003 |
| EP | 1512736 | * | 8/2004 |
| EP | 1612256 | | 1/2006 |
| FR | 2833862 | | 6/2003 |
| JP | 2005-82810 | | 3/2005 |
| JP | 2005-513204 | | 5/2005 |
| WO | 03/053560 | | 7/2003 |
| WO | 2005/032705 | | 4/2005 |

OTHER PUBLICATIONS

Breakspear et al., *Injector Deposit Test for Modem Diesel Engines*, Schik and Rouff of Automobil Prueftechnik Landau GmbH, Technische Akademie Esslingen symposium on Jan. 12-13, 2005.

Derwent WPI Week 197805—Derwent Publications Ltd., London GB; An 1978- 09197A XP002484453 & JP 52151304 A (Taiho Kogyo Co Ltd) Dec. 15, 1977 Abstract.

* cited by examiner

METHOD OF SUPPLYING IRON TO THE PARTICULATE TRAP OF A DIESEL ENGINE EXHAUST

The present invention concerns a method for supplying iron, via the fuel, to the particulate trap of a diesel engine exhaust in a form suitable for promoting trap regeneration.

In particular, the method involves the addition to the fuel of a colloid of iron oxide, as hereafter defined. Combustion of this colloid produces iron-containing compounds, especially iron oxides, which collect in association with the carbonaceous particulate matter in the particulate trap. These iron compounds promote the combustion of this carbonaceous material, either periodically or continuously, in either case leading to a reduction in the amount of particulate retained within the trap and keeping the trap functional over long periods.

Compared with prior art materials, the colloid in particular shows a lower level of associated deposit formation on the fuel injectors than the iron additives of the prior art. The method is thus particularly suitable for modern engines showing increased susceptibility to fuel injector deposits, especially in the presence in the fuel of metal salts, which appear to accentuate the injector fouling problem. The colloid also shows a balance of properties providing excellent suitability for use as an additive in fuels, and especially in diesel engine on-board dosing devices.

Carbonaceous fuels, whether of mineral (e.g. petroleum) or biological (e.g. animal and/or plant) origin, are a ubiquitous source of energy. In particular, much of the world is reliant on liquid carbonaceous fuels for powering vehicles, and for domestic and industrial power generation and heating. Efficient release of the energy contained within such fuels is dependent upon their effective combustion. Even in combustion devices of modern design, the chemical process of combustion typically does not run to completion, with the effect that a proportion of carbonaceous material is emitted not as carbon dioxide, but as one or more less oxidised species. In particular, particulate emissions comprising solid, carbon-rich matter are a well known by-product of incomplete combustion. The release of even small quantities of such emissions is under increasing environmental scrutiny.

The diesel engine has proved a popular choice for powering many devices, including inter alia forms of transport such as road vehicles, trains and marine craft. The ever-increasing emphasis on engine efficiency has imposed increasingly stringent emissions standards on diesel-powered transportation devices, especially road vehicles. Today, the engineer must typically deploy a range of emissions control strategies to meet modern legislative and social emissions targets.

One established strategy for the control of particulate emissions from diesel engines is the use of a particulate trap (also known as a particulate filter) within the exhaust system of the engine. The trap typically comprises a filter element, with pore size selected to generally permit through-flow of exhaust gases but retain the small particles of incompletely-burned material that constitute the 'particulate' element of diesel emissions. In this way, the natural efficiency of the modern diesel engine is augmented by an exhaust filtration process which traps a substantial proportion of the small quantity of particulate still produced by the engine. The gases leaving the exhaust system (the 'tailpipe emissions') are thus substantially free of particulate, enabling the engineer to reach very low particulate emissions targets.

The action of the particulate trap in filtering out particulate material in time leads to clogging of the filter element. If left unattended, the gaseous flow through the filter becomes hindered to such an extent that significant back-pressure builds up in the exhaust system, affecting the operation of the engine. In addition, the effective filtration of further particulate is inhibited. For these reasons, the filter element must in turn be cleaned of collected particulate to preserve efficient function. This cleaning process is typically known in the art as 'regeneration'.

Regeneration of the filter is itself effectively achieved through a combustion process. Several alternative approaches have been developed.

So-called 'active' systems rely on the periodic application of external energy (such as heat) to raise the temperature of the collected particulate to the point where its spontaneous ignition will occur in the trap. Diesel engines run on a lean air fuel stoichiometry, and the exhaust gas contains significant quantities of oxygen (left over from the air intake charge) which is available to combust the ignited particulate in situ. In such systems, the trap is therefore periodically a second combustion chamber, wherein the particulate is further combusted to gaseous products before leaving the tailpipe.

In contrast, 'passive' systems do not rely on external energy, but instead promote the in situ combustion of the collected particulate in other ways. Of these systems, the use of catalytic fuel additives has become accepted as a practical way to promote regeneration of particulate traps. Additives based on metals having the catalytic property of promoting ignition of the particulate at lower gas temperatures have been used commercially for this purpose. Spontaneous ignition of the particulate normally only occurs at temperatures of around 600° C. Such temperatures are typically only reached (unassisted) by the exhaust gases during prolonged high speed, high load operation of the engine. The presence of a catalytic additive lowers that spontaneous ignition temperature significantly, promoting ignition over a wider range of typical exhaust gas temperatures. In consequence, regeneration is effected under a wider engine operating envelope, without the need for external energy sources. Depending on the degree of ignition promotion, the ignition and burn-off of trapped particulate may occur in a cyclic ('stochastic') fashion or continuously.

A number of metals have been used, or proposed for use, in trap regeneration additives. Of these metals, iron has proved particularly suitable. On the one hand, iron has a catalytic property and promotes regeneration sufficiently to allow long-term trap operation. On the other hand, iron is environmentally benign. During combustion, the iron in iron-containing compounds is largely converted to iron oxides, which become entrained in the particulate matter formed by incomplete combustion in the combustion chamber. When this particulate is thereafter trapped on the filter element, the iron within the iron oxides is ideally positioned in situ amongst the carbonaceous material to be ignited, so enabling the ignition-promoting effect. The resulting tailpipe emissions ultimately release iron oxide, a naturally occurring substance, into the atmosphere.

However, the practical use of iron-containing regeneration additives has become associated with problems, which have nevertheless limited the use of iron-based additives.

Firstly, the iron-containing additive must be sufficiently soluble or dispersible within the fuel to actually reach the combustion chamber. Fuel distribution networks are typically complex and involve storage at intermediate depots and fuel service stations. Fuel may remain for days or even weeks in such environments. Similarly, on board the vehicle or other transportation device, the additive must remain evenly distributed in the fuel within the fuel tank. Additive which is lost from the bulk fuel through precipitation or sedimentation will be unable to effect regeneration, and can also cause filter blockage in the fuel system.

The tendency of an additive to remain well distributed within the fuel over time is hereinafter referred to as its "stability". To take better advantage of iron's beneficial properties as an additive, an iron-containing additive is required which shows high stability in fuel, particularly under typical storage conditions in the distribution network and the fuel tank.

In particular, an iron-containing additive is required which shows greater stability in the presence of other fuel components known to cause regeneration additives to precipitate or sediment out of the fuel. Certain lubricity additives deployed in modern diesel fuel are known to prompt known regeneration additives (based on various metals, including iron) to precipitate or sediment out of the fuel.

Whilst trap regeneration additives are occasionally added to the bulk fuel in the distribution network, increasingly they find application in 'on board' additive dosing systems. These systems comprise devices that supply additive from a separate tank to the fuel system on board the vehicle (or other device), avoiding the need for the additive to be added to the fuel further upstream. In this way, a particular engine and trap combination can be optimised for use with a single, defined additive. Thus, for example, some diesel engine vehicles in current production are equipped with on board dosing devices, whereby additive held in concentrate form in a discrete storage tank on board the vehicle is dosed, via suitable means, into the fuel on board the vehicle. Vehicle management systems control the level of dosage and monitor system operation. The additive tank contains sufficient additive to permit long-term operation, and can be replenished as necessary.

Such on board dosing systems likewise require additive which is stable in the bulk fuel.

In addition, however, on board storage requires the additive concentrate to possess a viscosity low enough to be compatible with the on board dosing device, and to hold a concentration of additive sufficient to permit long-term operation on a relatively small volume of concentrate. Space on board the modern vehicle (or other transportation device) is at a premium, and the on board additive tank and dosing device must both be small. In addition, complexity adds cost and must be kept to a minimum. Higher pressure devices (necessary for effective dosing of more viscous liquids) must be avoided.

These desired physical properties create conflicting demands on the additive concentrate, and have proved difficult to satisfy in practice. To obtain greater stability, the iron has typically been stabilised by associating it with long-chain organic species. In doing so, the molecular weight of the overall molecule or complex is increased, leading to higher concentrate viscosities and proportionately lower iron contents. Reducing this viscosity to manageable levels also requires greater dilution, leading to lower iron concentration levels which require larger additive tanks.

To take advantage of iron's beneficial trap regeneration properties, an iron-containing additive is required which not only shows greater stability but also exhibits lower viscosity in highly concentrate form, better satisfying the physical limitations of on board dosing systems. The present invention provides methods (and a use) involving a particular colloid which has been found to better satisfy these various physical demands.

Secondly, the introduction of iron compounds into diesel fuel has been associated with the formation of deposits on the fuel injectors of the engine. Diesel engine injectors have long been known to be susceptible to carbonaceous deposits, believed to be formed from the oxidation products of natural components of the diesel fuel. However, the use of iron in the form of organic iron salts has been observed to give additional deposit problems. The mechanism of this deposit formation is not fully understood, but involves the formation of deposits on the carefully-engineered surfaces of the injector parts. As a result, the spray pattern of the fuel upon injection is altered adversely, resulting in less complete combustion, and leading to poorer emissions performance and a measurable loss of engine performance, in particular engine torque. In addition, more advanced engines typically require more finely-engineered injectors built to finer tolerances (to meet more stringent emissions standards) and appear more susceptible to the problem.

Within this specification and claims, the term "adverse deposits" is used to describe those deposits which form on the fuel injector surfaces in operation of the engine and result in a measurable loss in engine performance, in particular a measurable loss in the torque developed by the engine under a constant set of operating conditions.

The increased incidence of adverse deposits on modern fuel injectors, and a method for measuring same, has been made available in the technical literature.

In the paper entitled "Impact of Fuel Additives on Diesel Injector Deposits", published in 2004 by the Society of Automotive Engineers ("SAE") under the reference "2004-01-2935", the authors Graupner and Klaua (Siemens GmbH) and Leedham and Caprotti (Infineum UK) note the modern advancements in fuel injector equipment, being driven by increasingly severe legislative controls on emissions. Increased temperatures and pressures at the injector tips (being exposed to both the inflowing fuel, and the combustion process) are said to characterise such equipment, and these physical factors are considered to contribute to increased deposit problems. Furthermore, the authors note that trace metal contamination, in particular with zinc, appears to contribute to the formation of increased levels of deposits, with chemical analysis also showing the presence of zinc within the deposits. The paper conducts tests which implicate acid lubricity additives, used in modern low sulphur diesel fuels to improve the lubricating properties thereof in injection systems, as one cause of such metal contamination. The paper also states that detergents used historically in diesel engine systems are proving less effective for these types of deposit.

The follow-up 2005 SAE paper entitled "Detergency Requirements of Future Diesel Injection Systems", from the same authors (but with Leedham now re-named Breakspear) under the reference 2005-01.3901, investigated these increased deposit tendencies using a test protocol previously released to the industry. The test itself, published at the Technische Akademie Esslingen symposium on 12 and 13 Jan. 2005 (by the same authors, in conjunction with Schik and Rouff of Automobil Prueftechnik Landau GmbH) under the title "Injector Deposit Test For Modern Diesel Engines", basically consists of an engine test run with a defined diesel fuel for two 8 hour periods separated by a soak period. The torque produced by the engine is monitored throughout the test, and the resulting torque profile over time used as a indicator of the build-up of adverse deposits on the fuel injectors. The SAE paper demonstrated both the impact of zinc contamination on the formation of adverse deposits and resulting loss of torque (and increase in smoke emissions), and also the increased susceptibility of future injector designs to such deposits. Existing detergent chemistries are again reported as less active against such deposits.

In its validating experiments, SAE 2004-01-2935 reported on the ability of acid lubricity additives to 'pick-up' metals of different kinds as might be encountered in modern fuel system materials. It noted that zinc and lead in particular were susceptible to pick-up, whilst iron (another common metal substrate in fuel systems) was not. However, such testing considered only the likelihood of iron pick-up from the fuel system substrate, and did not go on to consider the effect of iron per se in fuel systems where such iron has been deliberately added for other performance-related reasons.

The Applicant has now determined that the introduction of iron to the fuel, in the form of iron additives known hitherto in the art for trap regeneration, is also associated with an increase in adverse deposits on fuel injectors, as determined by a loss of engine performance in the above test, in particular a reduction in engine torque. This effect is believed to be analogous to the effect seen with zinc and accounts for the practical injector fouling problems encountered with iron-based regeneration additives.

To take better advantage of iron's beneficial trap regeneration properties, an iron-containing additive is thus required which also shows a lower tendency towards fuel injector fouling. In particular, an additive is required which is not associated with an increase in adverse deposits, and which allows the engine to function effectively without the need for injector detergent additives, and avoids any viscosity increase associated with the use of such detergents.

Furthermore, in addressing both the above problems of injector fouling and conflicting physical properties, it is also essential that the resulting iron-containing additive remains effective in its primary function as a trap regeneration additive.

The present invention provides a solution to these problems in the form of a specific iron-containing colloid which combines iron oxide particles with a particular means of dispersing the particles in the carrier fluid. The resulting colloid permits the preparation of more concentrated forms at manageable viscosities, better meeting the user's conflicting physical requirements. The colloid also shows excellent stability in the fuel, and demonstrates a lesser association with adverse deposits forming on the fuel injectors during use, even in the absence of detergent additives.

WO-A-2003/053560 describes organic colloidal dispersions of iron particles, and their use as fuel additives for trap regeneration. WO-A-2003/053560 requires as an essential feature of its invention that the iron within the colloid be amorphous in nature. The term amorphous is defined by reference to X-Ray diffraction patterns, and requires that the colloid show no significant peaks therein. WO-A-2003/053560 generally discloses carboxylic acids containing 10 to 50 carbon atoms as one possible amphiphilic agent stabilising the colloid, but does not describe the specific dispersing means of the present invention. No recognition of, or reference to, the injector fouling problem is made in this document.

EP-A-1 512 736 describes diesel fuels containing a colloidally dispersed or solubilised metal catalyst compound which can be used for particulate trap regeneration. Example 9 demonstrates the formation of a rearranged colloid, in which the prior art colloid Eolys® 176 (a mixed colloidal dispersion of cerium and iron oxide) is stabilised by the addition of stabiliser A (polyisobutylene succinic acid). In fact, Eolys®176 is also amorphous in nature (as shown by X-Ray diffraction studies in the examples which follow). EP-A-1 512 736 generally makes no reference to the injector fouling problem and does not specifically disclose the colloid of the present invention. Furthermore, all the colloid examples recited in this document essentially contain cerium.

EP-A-1 344 809 describes diesel fuel compositions improving the operation of particulate traps which comprise a combination of metal (in the form of a metal salt additive) and an oil soluble nitrogen containing ashless detergent additive. The additive combination is reported to be a stable additive system and cooperatively effective in improving the operation of the trap. Injector fouling performance is not mentioned and the iron within the fuel exists in salt, not colloid, form.

In a first aspect, the invention provides a method of supplying iron to the particulate trap of a diesel engine exhaust in a form suitable for promoting trap regeneration, the method comprising the following steps:

a. preparing or otherwise obtaining a colloid consisting of iron oxide particles dispersed in a carrier fluid, the dispersing means within the colloid being one or more carboxylic acid compounds as hereafter defined;
b. adding the colloid to a diesel fuel, in an amount which provides the iron concentration desired within the fuel for promoting trap regeneration;
c. combusting the fuel composition resulting from step b. in a diesel engine equipped with a particulate trap in its exhaust system; and
d. within the particulate trap, thereafter collecting the iron-containing compounds resulting from combustion, in association with at least some of the carbonaceous particulate matter emitted by the engine;

wherein at least one carboxylic acid compound within the colloid is a hydrocarbyl-substituted dicarboxylic acid containing between 8 and 200 carbon atoms, and wherein any additional carboxylic acid compounds within the colloid are either hydrocarbyl-substituted dicarboxylic acids containing between 8 and 200 carbons, or aliphatic monocarboxylic acids containing between 8 and 20 carbon atoms, or mixtures thereof; and wherein the weight ratio of carboxylic acid(s): iron in the colloid (measured as the total weight of acid compound(s) weight of elemental iron contained within the iron oxide particles) is in the range of 6:1 to 1:4.

In a second aspect, the invention provides a method of regenerating a particulate trap fitted to the exhaust system of a diesel engine-powered device, comprising:

i) the supply of iron to the trap in accordance with the method of the first aspect, and
ii) operating the engine or the trap in a manner effective to cause or permit the combustion, at least periodically, of at least some of the carbonaceous particulate collected in the trap.

In a third aspect, the invention provides the use of a colloid consisting of iron oxide particles dispersed in a carrier fluid as the means for supplying iron to the particulate trap of a diesel engine exhaust in a form suitable for promoting trap regeneration; wherein the colloid is added to the fuel and provides, after combustion, iron-containing compounds suitable to promote trap regeneration (and, preferably, without an associated increase in adverse deposits on the fuel injectors of the engine); and wherein the dispersing means within the colloid consists of at least one hydrocarbyl-substituted dicarboxylic acid containing between 8 and 200 carbon atoms; and wherein any additional carboxylic acid compounds within the colloid are either hydrocarbyl-substituted dicarboxylic acid containing between 8 and 200 carbon atoms, or aliphatic monocarboxylic acids containing between 8 and 20 carbon atoms, or mixtures thereof, and the weight ratio of carboxylic acid(s):iron in the colloid (measured as the total weight of acid compound(s):weight of elemental iron contained within the iron oxide particles) is in the range of 6:1 to 1:4.

The advantages and features of the invention are hereafter described in more detail.

In relation to the first and second aspects of the invention (method) and the third aspect of the invention (use), the term "supplying iron to the particulate trap of a diesel engine exhaust in a form suitable for promoting trap regeneration" should be understood to mean the supply of iron in a physical and chemical form suitable for catalysing the ignition of carbonaceous particulate matter emitted by the engine, as measured by, for example, a reduction in the ignition temperature thereof within the trap, when the iron is present in association.

By following the methods and use of this invention, the addition of the iron-based colloid in particular results in the release from the combustion chamber of iron-containing compounds which comprise particles of iron oxide(s), which become entrained with the particulate matter collecting in the trap, and so provide iron in the necessary form. However, the combustion process may also form iron sulphate(s) depending upon the sulphur content of the diesel fuel, as well as other iron oxidation products. The provision of such additional compounds to the trap, also supplying iron in particulate form so permitting it to associate with the carbonaceous particulate and act catalytically, is included within the above term.

The first and second aspects of the invention (method) and the third aspect of the invention (use) are particularly suitable for diesel engines used which exhibit loss of engine performance due to the formation of fuel injector deposits associated with the presence of organic metal salts in the fuel. Such engines are particularly susceptible to injector fouling in modern environments, where the engine is exposed either to metal-based fuel additives (for trap regeneration or other purposes) or to metals leached into the fuel from the fuel distribution system, for example from the action of acid materials introduced as additives or present as contaminants.

This engine susceptibility to adverse deposits is particularly demonstrated by a sensitivity towards small levels of zinc, as detailed in the above-cited literature. Thus, the loss of engine performance due to the formation of fuel injector deposits can preferably be determined by measurement of a reduction in engine torque when the engine is run on a fuel containing one or more organic zinc salts in an amount sufficient to provide at least 1 part, and preferably 3 parts, per million (by weight, per weight of fuel) of elemental zinc to the fuel, preferably in accordance with the engine test method detailed in the SAE publication 2005-01-3901 cited above, incorporated by reference herein as part of the disclosure of the invention, and further detailed in the accompanying example W3, section a).

The method of the first and second aspects (and the use of the third aspect) of the invention has the result and advantage of supplying iron to the trap in a form suitable for promoting trap regeneration, in a manner associated with a lower increase in adverse deposits on the fuel injectors of the engine, and preferably without an associated increase in adverse deposits.

In relation to all aspects of the invention, it is essential that the particles within the colloid consist of iron oxide. From the examples that follow, it is apparent that even an engine generally susceptible to adverse deposits on the fuel injectors does not significantly lose performance when run on diesel fuel containing the iron oxide colloid of the invention at levels normally desired for promoting trap regeneration. In contrast, both an analogous iron colloid dispersed by different means, and iron in the form of its organic salt, lead to a progressive loss of engine performance when present at levels providing the fuel with the same concentration of elemental iron—this loss of performance being determined by a reduction in engine torque when the engine is run on a fuel containing such iron materials, using a test protocol such as that explained above.

The iron oxide core of the colloid may be crystalline or amorphous, although preferably it is crystalline. In this specification and claims, the terms "crystalline" and "amorphous" used in relation to the iron oxide core have defined meanings. The core is crystalline if, under X-Ray diffraction of the colloid, one or more sharp peaks are observed which are attributable to the existence of a defined crystal structure or lattice within its core. The core is amorphous if no such attributable peaks are observed.

A suitable protocol for conducting the required X-Ray diffraction of the colloid is firstly to prepare the sample for scanning by applying the relevant liquid (colloid) directly onto a silicon low background substrate, and allowing the sample to dry. The sample forms a viscous tacky film which can then be investigated. Suitable X-Ray data can be collected from 2-70 degrees 2 theta on a Philips PW 1800 automatic powder X-ray diffractometer using Copper K alpha radiation generated at 40 kV and 55 mA, and a 4 second per point count time.

Figure 3:
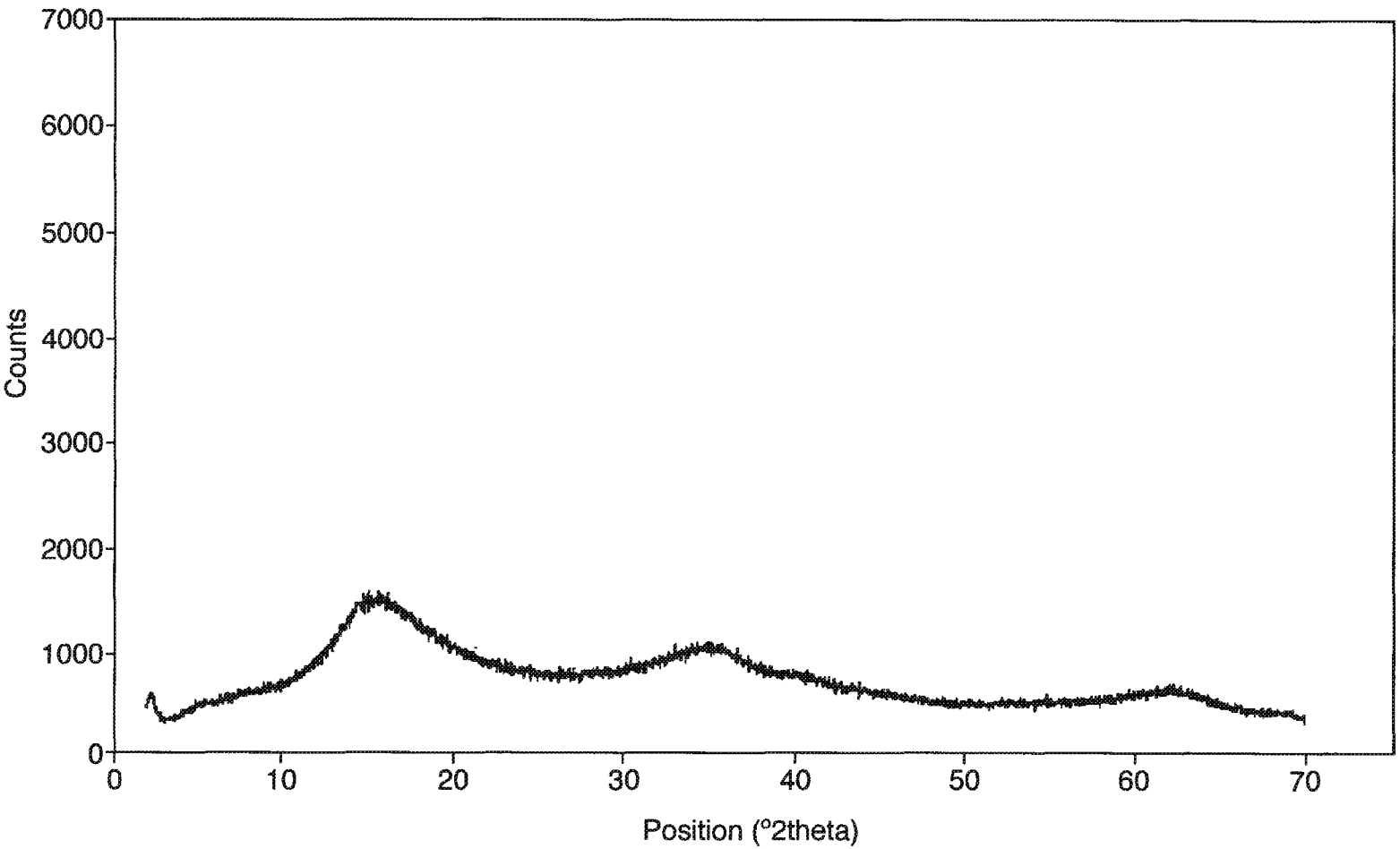
Figure 4:
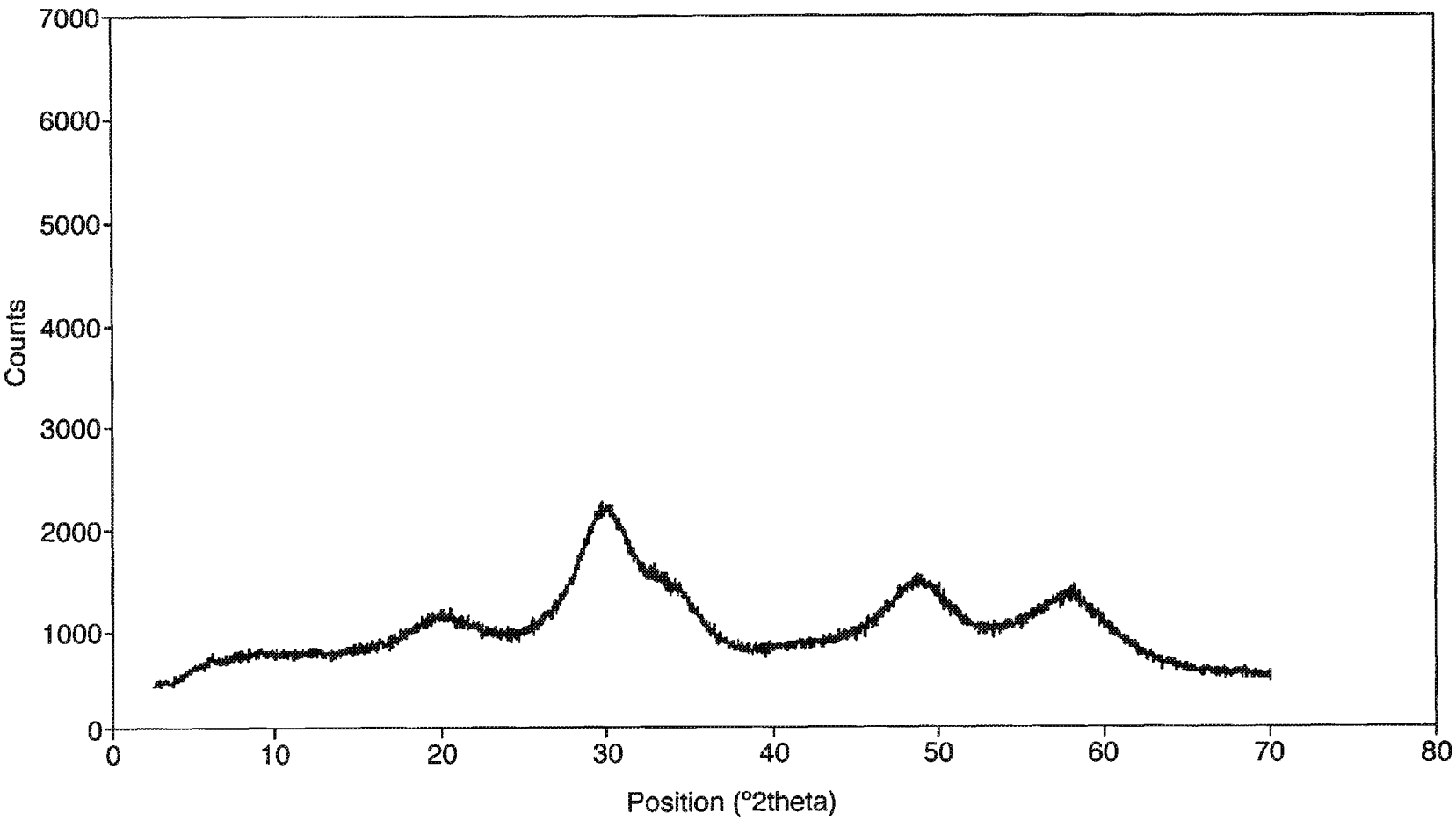
Figure 5:
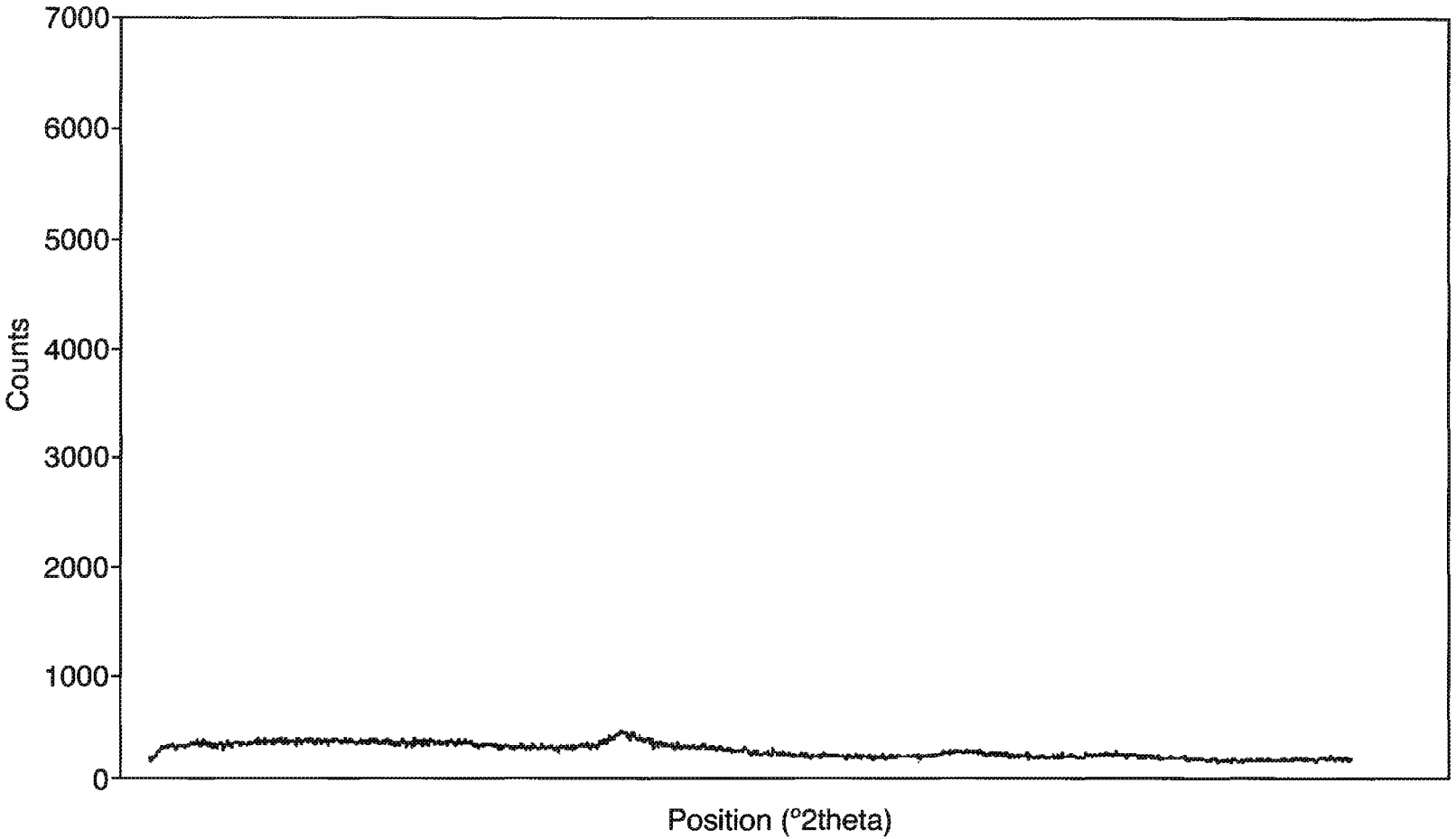

The appended figures illustrate typical X-Ray diffraction patterns originating from colloids of crystalline and amorphous iron oxide particles respectively, obtained by applying the above method. In FIG. 1, an X-Ray diffraction pattern for a crystalline example, the presence of sharp peaks (attributable by comparison with standard library spectra to magnetite, with a small quantity of goethite) are readily seen. FIG. 3 illustrates the X-Ray diffraction pattern for an amorphous iron oxide colloid, with no sharp peaks being visible.

Iron oxide itself can exist in a variety of forms dependent upon the oxidation state (or mixture of oxidation states) of the iron therein, and the conditions to which it has been exposed. In this specification and claims, the term "iron oxide" is used generically to mean both true iron oxides and also iron hydroxides and iron oxide-hydroxides generally referred to in the art under the term 'iron oxide'. In all cases however, no metals other than iron are present within the iron oxide, and thus the colloid core consists of iron as the only metal, in combination with oxygen and/or hydrogen depending upon the precise form(s) of iron oxide present.

It is preferred that the iron oxide particles within the colloid consist essentially of crystalline form(s) of iron oxide. Such crystalline forms of iron oxide specifically include the oxides magnetite ($Fe_3O_4$), hematite ($\alpha$-$Fe_2O_3$) and maghemite ($\gamma$-$Fe_2O_3$) as well as other iron (III) oxide forms such as the iron (II) oxide "Wustite FeO". Of these true oxides, magnetite, hematite and maghemite are preferred, with magnetite being most preferred. Magnetite and hematite in particular can be mined in more form in large quantities.

Crystalline forms of iron hydroxides and iron oxide-hydroxides specifically include goethite ($\alpha$-FeOOH) and lepidocrocite ($\gamma$-FeOOH) as well as the $\delta$-FeOOH (synthetic) and $\delta'$-FeOOH (mineral) forms, ferrihydrite $Fe_5O_3.4H_20$, bernalite $Fe(OH)_3$ and $Fe(OH)_2$. Goethite in particular is a thermodynamically stable form and is available in rocks and ochre deposits. Lepidocrocite occurs in rocks and soils, and ferrihydrite is widespread in natural surface environments. Of the iron hydroxides and iron oxide-hydroxides, the goethite and lepidocrocite forms are most preferred.

Preferably, from a performance point of view, the crystalline iron oxide core of the colloid consists essentially of the crystalline form magnetite, optionally also incorporating lesser quantities of one or more of the hematite, maghemite, goethite or lepidocrocite forms. A core consisting of magnetite is the most preferred form of crystalline iron oxide for use in the present invention, optionally in combination with goethite.

The iron oxide core (whether crystalline or amorphous) is dispersed within a carrier fluid by a dispersing means being one or more carboxylic acids, wherein at least one of the acids is a hydrocarbyl-substituted dicarboxylic acid containing between 8 and 200 carbon atoms, and wherein any additional carboxylic acids are either aliphatic monocarboxylic acids containing between 8 and 20 carbon atoms, or hydrocarbyl-substituted dicarboxylic acids containing between 8 and 200 carbon atoms, or mixtures thereof; and wherein the weight ratio of carboxylic acid(s):iron in the colloid (measured as the total weight of acid compound(s):weight of elemental iron contained within the iron oxide particles) is in the range of 6:1 to 1:4.

In a first, preferred embodiment the dispersing means within the colloid consist of one or more hydrocarbyl-substituted dicarboxylic acids containing between 8 and 200 carbon atoms. Preferably, the or each hydrocarbyl-substituted dicarboxylic acid is a hydrocarbyl-substituted succinic acid, more preferably an alkenyl or polyalkenyl succinic acid, preferably a polyalkenyl succinic acid.

As used within this specification and claims, the term 'hydrocarbyl substituent' means a monovalent chemical substituent having hydrocarbonaceous character, and consisting of carbon and hydrogen atoms (and optionally heteroatoms such as oxygen, nitrogen and sulphur, provided that the presence of such heteroatoms does not affect the hydrocarbonaceous character of the substituent). In each of the preferred embodiments of the dicarboxylic acid, the hydrocarbyl substituent consists of carbon and hydrogen atoms (only), wherein the hydrocarbyl substituent is preferably a monovalent saturated (i.e. alkyl), or more preferably mono or polyunsaturated substituent, such as alkenyl. Branched chain substituents are preferred.

The preferred maximum size of such the hydrocarbyl substituents is 160 carbon atoms, preferably 80 carbon atoms. Preferably, the substituents contain at least 12 carbon atoms, and more preferably at least 18 carbon atoms. Branched-chain substituents, and especially alkenyl or polyalkenyl substituents, containing between 18 and 80 carbon atoms are most preferred.

Preferably, a mixture of hydrocarbyl-substituted dicarboxylic acids is used. More preferably, the mixture is a mixture of dicarboxylic acids wherein each acid is an alkenyl- or polyalkenyl-substituted succinic acid and wherein the mixtures preferably consist essentially of (and more preferably consist of) succinic acids which carry only one branched-chain polyalkenyl substituent, preferably containing between 18 and 80 carbon atoms.

In this latter preferred embodiment, the substituent on each succinic acid may be derived from polymerised olefins, such as polyethylene, polypropylene or (preferably) polybutylene such as polyisobutene. A preferred substituent is derived from polyisobutene of number average molecular weight (as measured by gel permeation chromatography ('GPC') against polystyrene standards) in the range of 450 to 2250, preferably 750 to 1300. Such polyisobutenes can be made by conventional polymerisation techniques known in the art, and thereafter attached to maleic anhydride via well-known chlorination or thermal reaction routes to give the preferred polyisobutenyl-succinic acid(s).

A further preferred embodiment of the present invention is that wherein the dispersing means consists of one or more aliphatic-substituted succinic acids derived from the structure (I):

(I)

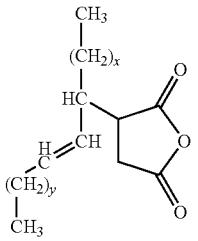

wherein x and y are independent integers whose sum is 9 to 29, preferably 11 to 21, and more preferably 11 or 13. Mixtures of such materials may again be derived from the maleation of a mixture of internal olefins of different chain lengths, or from maleation of an isomeric mixture of internal olefins of the same chain length. The internal olefins may be generated in situ by the acid-catalysed isomerisation of terminal olefins, prior to reaction with the maleic anhydride.

In the second, more preferred embodiment of the invention, the dispersing means within the colloid consists of one or more hydrocarbyl-substituted dicarboxylic acids containing between 8 and 200 carbon atoms in combination with one or more monocarboxylic acids containing between 8 and 20 carbon atoms. In this embodiment, the preferred embodiments previously described for the hydrocarbyl-substituted dicarboxylic acids may suitably be combined with one or more of the above-stated monocarboxylic acids.

Thus, one or more monocarboxylic acids containing between 8 and 20 carbon atoms may be combined with one or more hydrocarbyl-substituted dicarboxylic acids containing between 8 and 200 carbon atoms, wherein the or each hydrocarbyl-substituted dicarboxylic acid is preferably a hydrocarbyl-substituted succinic acid, more preferably an alkenyl succinic acid or most preferably a polyalkenyl succinic acid.

In such mixtures, the preferred maximum size of such hydrocarbyl substituents is 160 carbon atoms, preferably 80 carbon atoms. Preferably, the substituents contain at least 12 carbon atoms, and more preferably at least 18 carbon atoms. Branched-chain substituents, and especially alkenyl or polyalkenyl substituents, containing between 18 and 80 carbon atoms are most preferred.

Preferably, a mixture of hydrocarbyl-substituted dicarboxylic acids is used in such a mixture. More preferably, each acid in the mixture is an alkenyl- or polyalkenyl-substituted succinic acid and wherein the mixtures consist essentially of (and preferably consist of) succinic acids which each carry only one branched-chain polyalkenyl substituent, preferably containing between 18 and 80 carbon atoms.

In this latter preferred embodiment, the substituent on each succinic acid may be derived from polymerised olefins, such as polyethylene, polypropylene or (preferably) polybutylene such as polyisobutene. A preferred substituent is derived from polyisobutene of number average molecular weight (as measured by gel permeation chromatography ('GPC') against polystyrene standards) in the range of 450 to 2250, preferably 750 to 1300. Such polyisobutenes can be made by conventional polymerisation techniques known in the art, and thereafter attached to maleic anhydride via well-known chlorination or thermal reaction routes to give the preferred polyisobutenyl-succinic acid(s).

A further preferred embodiment is that obtained by employing, in combination with the one or more carboxylic acids, one or more aliphatic-substituted succinic acids derived from the structure (I):

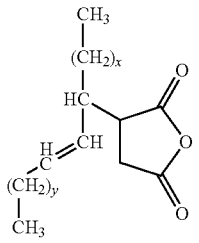

(I)

wherein x and y are independent integers whose sum is 9 to 29, preferably 11 to 21, and more preferably 11 or 13. Mixtures of such materials may again be derived from the maleation of a mixture of internal olefins of different chain lengths, or from maleation of an isomeric mixture of internal olefins of the same chain length. The internal olefins may be generated in situ by the acid-catalysed isomerisation of terminal olefins, prior to reaction with the maleic anhydride.

Thus, in this embodiment, the dispersing means within the colloid preferably consists of one or more polyalkenyl-substituted succinic acids in combination with one or more aliphatic monocarboxylic acids containing between 10 and 18 carbon atoms.

In a particularly preferred embodiment, said dispersing means within the colloid consists of oleic acid and one or more polyisobutenyl succinic acids, the polyisobutenyl group(s) of which have a number average molecular weight (as measured by gel permeation chromatography, against polystyrene standards) of between 450 and 2300.

In this second embodiment, the dispersing means additionally contains one or more aliphatic monocarboxylic acids containing between 8 and 20 carbon atoms. Preferably, the or each monocarboxylic acid contains between 10 and 18 carbon atoms. Such acids may be straight or branched chain acids, and include saturated straight chain acids such as decanoic acid, dodecanoic acid, tetradecanoic acid, hexadecanoic acid and octadecanoic (stearic) acid, as well as mixtures thereof; saturated branched chain acids such as neodecanoic acid and isostearic acid; and furthermore include monounsaturated acids such as cis-9-hexadecenoic (palmitoleic), cis-6-octadecenoic (petroselinic), cis-9-octadecenoic (oleic), cis-11-octadecenoic (cis-vaccenic) and cis-15-tetradecenoic (nervonic) acids, and polyunsaturated fatty acids such as 9,12-octadecadienoic (linoleic), 6,9,12-octadecatrienoic (γ-linoleic) and 9,12,15-octadecatrienoic (α-linoleic) acids.

Of these acids, the unsaturated acids are preferred, with oleic acid per se, or mixtures consisting essentially of oleic acid, being most preferred as the dispersing means for the colloid.

Most preferably in the second embodiment of the invention, the dispersing means within the colloid preferably consists of one or more polyisobutenyl-substituted succinic acids in combination with one or more aliphatic monocarboxylic acids containing between 10 and 18 carbon atoms. The combination of oleic acid and a mixture of polyisobutylene-substituted succinic acids, wherein the polyisobutylene substituents have a number average molecular weight (as measured by GPC) in the range of 700 to 1300, and particularly the range of 900-1000, is most preferred.

It is particularly preferred in the second embodiment that the above mixtures of monocarboxylic acids and hydrocarbyl-substituted dicarboxylic acids form the dispersing means for particles which consist essentially of crystalline form(s) of iron oxide, and especially which consist essentially of magnetite.

In the methods and use of the invention, the weight ratio of carboxylic acid(s):iron in the colloid (measured as the weight of acid compound(s):weight of elemental iron contained within the iron oxide particles) is in the range of 6:1 to 1:4. Preferably, this weight ratio is in the range of 4:1 to 1:2, more preferably 2:1 to 1:2. Most preferably, this weight ratio is in the range of 1.5:1 to 1:2.

The weight ratio of carboxylic acid(s):iron in the colloid is important in controlling the properties of the colloid, and hence its suitability in the methods (first and second aspects) and use (third aspect) of the invention.

In particular, the viscosity of the colloid decreases as the weight ratio of carboxylic acid(s):iron decreases. Thus, ratios below 2:1, such as the range of 1.5:1 to 1:4, provide the colloid with the viscosity characteristics preferred for the methods and use of the invention.

However, the stability of the colloid within diesel fuel follows the reverse trend. Thus, increasing the weight ratio of carboxylic acid(s):iron in the colloid improves its stability. Conversely, decreasing the ratio adversely effects the stability, and provides less desirable physical behaviour in fuel for the colloid's deployment in the invention. In particular, a ratio between 6:1 and 1:1 is preferred for optimal stability in base diesel fuel. However, as the examples hereafter show, colloids having lower ratios in the range of 1:1 to 1:2 are more resistant to the additional presence in the fuel of a destabilising element (such as a lubricity additive, like esters of unsaturated acid dimers).

The ratio range defined for the present invention provides the optimum balance of these properties. Within the broad range of 6:1 to 1:4, the skilled person is provided a general range of useful colloid compositions from which a material having the optimum balance for a given circumstance can be chosen.

Thus, for example, in an application for an engine system that has more demanding base fuel stability requirements, a colloid with a higher ratio within the general range can be used. On the other hand, for an engine system that is more concerned with fuel stability requirements in the presence of lubricity additives, a colloid with a lower ratio within the general range can be used. It is naturally within the routine skill of the skilled person to identify the necessary performance targets and identify the colloid most appropriate to those targets, for example by the use of test procedures for measuring viscosity and/or stability.

However, the colloids wherein the weight ratio of carboxylic acid(s):iron is within the preferred range of 4:1 to 1:2, especially the more referred range of 2:1 to 1:2, and particularly the most preferred range of 1.5:1 to 1:2, provide a balance of physical and injector fouling properties that is considered optimal for general usage, in particular for on-board applications wherein the colloid is stored on board a vehicle fitted with on board dosing means as hereafter described.

In the colloid, the iron oxide particles are dispersed in a carrier fluid, so providing a concentrate form suitable for use as an additive.

The colloid can be made to concentration levels suitable for use in bulk fuel manufacture or blending operations at refineries or fuel terminals. In such concentrates, the colloid is typically present in concentrations containing up to 30% iron by weight, and preferably between 5 and 20%, more preferably between 15 and 25% by weight, per weight of colloid.

Additionally, the colloid of the invention can be made to high concentration levels suitable for long-term use in on board dosing systems. As previously explained, such dosing systems require the concentrate to remain homogeneous for extended periods, to permit consistent operation of the trap regeneration system. In such concentrates, the polymer is also typically present in concentrations containing up to 40% iron by weight, and preferably between 10 and 30%, more preferably between 15 and 25% by weight, per weight of concentrate.

Suitable carrier fluids for the colloid include aromatic solvents such as the commercial mixed aromatic solvents Solvesso and Shellsol, and aliphatic solvents such as isoalkanes, including Isopar L. Other suitable solvents known in the additives art may be used, such as Norpar (pentanes), Exxsol (dearomatised hydrocarbon fluids), Nappar (naphthenics), Varsol (non-dearomatised hydrocarbon fluids), xylenes, and HAN 8080 (aromatic solvent).

The concentration of iron colloid deployed in the fuel under all aspects of the present invention will be that desired by the skilled person to provide the desired degree of trap regeneration. This, in turn, will be governed by the engine system in question and the manufacturer's (or user's) recommendations or instructions for optimum trap operation. Typically, the recommendation or instruction will set the level of iron in the fuel that corresponds to the desired rate of accumulation of iron-containing compounds in the trap. This level is typically controlled by the particulate signature of the engine, the range of typical exhaust gas temperatures and the properties of the trap (and any auxiliary regeneration aid) in question. In addition the planned frequency or size of the required regeneration events will determine the desired level. Frequently, such levels are set during engine or exhaust system development and as a result of optimisation testing.

However, for general purposes a colloid concentration within the fuel sufficient to provide between 1 and 30, and preferably between 2 and 15, more preferably between 3 and 12 ppm of iron in the fuel (where "ppm" is parts per million of elemental iron, by weight, per weight of fuel) will be useful in the present invention. Levels between 4 and 10 ppm are most preferred.

In general, higher levels of iron will result in greater catalytic activity (through a higher concentration of catalyst within the trap), but will additionally result in a greater mass of iron-containing compound(s) (or "ash") which, when entrained within the carbonaceous particulate, also contribute to overall particulate mass measured for emissions regulation purposes. Thus, the optimum iron concentration for a particular engine will typically be the lowest concentration obtaining the required catalytic (trap regeneration) properties. It is a further advantage of the present invention that the iron colloid results in the formation of iron-containing compounds having a high catalytic activity within the trap, thus allowing the use of concentrations of colloid in the fuel which lessen the significance of the contribution of the iron to the mass of particulates produced by the engine.

The diesel fuel to be treated with the colloid may be a petroleum-based diesel fuel oil. Such diesel fuel oils generally boil within the range of from 110° C. to 500° C., e.g. 150° C. to 400° C. The fuel oil may comprise atmospheric distillate or vacuum distillate, cracked gas oil, or a blend in any proportion of straight run and thermally and/or refinery streams such as catalytically cracked and hydro-cracked distillates.

Other examples of diesel fuel oils include Fischer-Tropsch fuels. Fischer-Tropsch fuels, also known as FT fuels, include those described as gas-to-liquid (GTL) fuels, biomass-to-liquid (BTL) fuels and coal conversion fuels. To make such fuels, syngas ($CO+H_2$) is first generated and then converted to normal paraffins by a Fischer-Tropsch process. The normal paraffins may then be modified by processes such as catalytic cracking/reforming or isomerisation, hydrocracking and hydroisomerisation to yield a variety of hydrocarbons such as iso-paraffins, cyclo-paraffins and aromatic compounds. The resulting FT fuel can be used as such or in combination with other fuel components and fuel types to arrive at a fuel suitable for use as diesel fuel.

Suitable examples of diesel fuel derived from oils or fats of animals and/or plants are those derived from rapeseed oil, coriander oil, soyabean oil, cottonseed oil, sunflower oil, castor oil, olive oil, peanut oil, maize oil, almond oil, palm kernel oil, coconut oil, mustard seed oil, jatropha oil, beef tallow and fish oils. Further examples include oils derived from corn, jute, sesame, shea nut, ground nut and linseed oil and may be derived therefrom by methods known in the art. Rapeseed oil, which is a mixture of fatty acids partially esterified with glycerol is available in large quantities and can be obtained in a simple way by pressing from rapeseed. Recycled oils such as used kitchen oils are also suitable.

Also suitable are alkyl ester derivatives of the fatty acid constituents of animal and plant oils and fats. Such esters can be obtained conventional means, for example by trans-esterification, or by saponification followed by re-esterification. Consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 wt % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of animal and vegetable fats and oils by their transesterification with lower aliphatic alcohols. For production of alkyl esters of fatty acids it is advantageous to start from fats and oils which contain low levels of saturated acids, less than 20%, and which have an iodine number of less than 130. Blends of the following esters or oils are suitable, e.g. rapeseed, sunflower, coriander, castor, soyabean, peanut, cotton seed, beef tallow etc. Alkyl esters of fatty acids based on a variety of rapeseed oil, the fatty acid component of which is derived to more than 80 wt % from unsaturated fatty acids with 18 carbon atoms, are preferred.

Whilst many of the above oils may be used, preferred are vegetable oil derivatives, of which particularly preferred biofuels are alkyl ester derivatives of rapeseed oil, cottonseed oil, soyabean oil, sunflower oil, olive oil, or palm oil, rapeseed oil methyl ester being especially preferred.

At present, fuels derived from oils or fats of animals and/or plants are most commonly used in combination with petroleum-derived fuels. The present invention is applicable to mixtures of such fuels in any ratio. For example, at least 2% and preferably at least 5%, more preferably at least 25%, for example more than 50% by weight of these fuel mixtures may be derived from a plant or animal source.

The diesel fuel may be a fuel for a road vehicle. Such fuels are typically classified in Europe by various well-known industry standards and can contain low or very low sulphur contents, such as at most 50 ppm sulphur, or even at most 10 ppm of sulphur or less by weight, per weight of fuel.

The fuel may alternatively be a marine diesel fuel, in particular having one or more of the following characteristics:

(i) a 95% distillation point (ASTM D86) of greater than 330° C., preferably greater than 360° C., more preferably greater than 400° C., and most preferably greater than 430° C.;

(ii) a cetane number (measured by ASTM D613) of less than 55, such as less than 53, preferably less than 49, more preferably less than 45, most preferably less than 40, (iii) an aromatic content of greater than 15% wt, preferably greater than 25% and more preferably greater than 40%; and (iv) a Ramsbottom carbon residue (by ASTM D 524) of greater than 0.01% mass, preferably greater than 0.15% mass, more preferably greater than 0.3% mass, such as 1% or 5% mass, and most preferably greater than 10% mass.

Such diesel fuels (and particularly such marine diesel fuels) may in particular contain streams such as streams produced from fluid catalytic cracking, such materials usually having a density @ 15° C. of 850 to 970, such as 900 to 970 kg/m$^3$ and characterised by low cetane number values, typically ranging from 10 or lower to around 30 to 35; from thermal cracking processes, like visbreaking and coking, such streams typically having a density range @ 15° C. of 830 to 930 kg/m$^3$ and a cetane value of 20 to 50; and from hydrocracking that uses severe conditions, e.g. temperature in excess of 400° C. coupled with pressures of 130 bars or greater, to produce streams characterised by cetane number from 45 to 60 and having a density range @ 15° C. from 800 to 860 kg/m$^3$.

Typically, marine fuels accord with the standard specification ASTM D-2069 and may be either distillate or residual fuels as described within that specification, and may in particular have sulfur contents of greater than 0.05%, preferably greater than 0.1%, more preferably greater than 0.2% and particularly greater than 1% or even 2% by weight, especially in the case of residual fuel oils, and a kinematic viscosity at 40° C. in cSt of at least 1.40.

The fuel compositions of the invention may also contain other additives. A particular advantage of the composition of the invention is the resistance to destabilisation that the colloid offers when the fuel composition additionally comprises a lubricity additive, particularly where such additive is the mono- or bis-glycol (or polyglycol) ester of a polycarboxylic acid (and especially of a dicarboxylic acid, such as a dimer of unsaturated fatty acids such as oleic acid). Such compositions show excellent stability and provide the fuel user with more reliable operation in the method aspect stated above.

The lubricity additive is typically present in amounts in the range of 25 to 500 ppm, preferably 50 to 250 ppm, and more preferably 100 to 200 ppm by weight per weight of fuel.

In the method (and the use) according to the invention, the iron-containing compounds resulting from the combustion of the fuel in step c. comprise iron oxide(s) and are particulate in form, and become entrained within the carbonaceous particulate matter collecting in the trap in step d. In preferred methods and the preferred use, the iron-containing compounds resulting from combustion of the fuel in step c. consist essentially of one or more forms of iron oxide, and optionally also iron sulphate(s).

The methods (and use) according to the invention are applicable to all diesel engines fitted with particulate traps. However, the methods (and use) are especially suitable wherein the colloid is added to the diesel fuel on board the device fitted with the diesel engine being employed.

The device may be any device employing diesel-engine power. Thus, whilst such devices include inter alia forms of transport such as road vehicles, trains and marine craft, the devices also include stationary engine devices such as generators, pumps and traction equipment, and in particular devices used in restricted or highly pollution-controlled environments such as mines and factories. Preferably however, the devices are road vehicles, trains and marine craft, in particular diesel engine road vehicles such as diesel trucks and diesel passenger cars.

A variety of on board means for storage and additive dosing are known in the art. Such equipment comprises an additive reservoir in fluid communication with a dosing device, the dosing device in turn being in fluid communication with the fuel system of the engine and serving to dispense the dose of additive into the fuel. The dosing device may dispense additive continuously, for example into the fuel line, or discontinuously, for example into the engine fuel tank at periodic refueling events. The device may be suitably adapted to improve dispersion of the additive upon addition to the fuel. The frequency of dosing, and the metered quantity of additive to be dosed, may be controlled by mechanical means, or preferably by the electronic management system on board the vehicle.

Thus, the methods of the invention also especially relate to devices which are a road vehicles carrying the fuel and the colloid in discrete reservoirs, wherein the addition of colloid (step b.) is effected by dosing the colloid into the fuel tank or into a vehicle fuel line in the desired amount using a dosing apparatus.

In the methods and use of the invention, the colloid employed can be prepared by either of the following methods.

In a first method, the iron oxide(s) of choice may be directly dispersed in the dispersing means of choice, by mixing finely-divided divided iron oxide(s) together with the dispersing means within the carrier fluid, for example by a commination or ball milling process.

In a second method, preferred for the dicarboxylic acid-stabilised colloid embodiment, the colloid of choice may be prepared by a two-stage process, wherein the first stage prepares a starting dispersion of the chosen iron oxide(s) (the 'stock dispersion') dispersed by a monocarboxylic acid such as oleic acid, and the second stage effects a reaction on the stock dispersion to incorporate the preferred dispersing means into the colloid. Depending on the stoichiometry of the reaction, this incorporation may lead to a proportion of the initial dispersing means being displaced from the colloid. Thus, for example, a stock dispersion dispersed by oleic acid may thereafter be reacted with one or more alkenyl succinic acids to incorporate the alkenyl succinic acids within the colloid, causing a partial or whole replacement of the oleic acid as dispersing means.

For the preferred the stock dispersion consisting essentially of the magnetite crystalline form of iron oxide, the magnetite may first be prepared chemically from a solution of a mixture of iron(II) and iron(III) salts in water in a 1:2 ratio, to which is added ammonium hydroxide causing the bare nanoparticles of magnetite to form in an inorganic polymerisation-condensation reaction. Monocarboxylic acid, for example oleic acid, is then added to this nanoparticle dispersion with stirring and heating to coat the particles (which settle to the bottom of the flask). These acid-stabilised particles are soluble or dispersible in organic solvents. The water layer may be decanted off and the residual water in the product removed, for example by azeotropic distillation.

Alternatively, the stock dispersion can be obtained from a suitable supplier as an item of commerce.

In this second method, the incorporation reaction can suitably be performed by charging the stock dispersion and preferred dispersion means into a suitably-sized reactor. The reactor is thereafter purged with nitrogen gas and sealed at atmospheric pressure, before being heated with stirring to a temperature of between 100° C. and 180° C., preferably between 130° C. and 160° C., more preferably between 140° C. and 150° C. Upon reaching the desired temperature, the stirring under temperature is continued for a reaction period of 1 to 10 hours, preferably 2 to 6 hours, more preferably 3 to 4 hours. During the process a moderate pressure rise (to approximately 14 psi) can be observed within the reactor. After the reaction period, the temperature of the reaction mixture is decreased and the colloid product drained from the reactor once it has cooled. The concentrated stabilised colloidal dispersion may be diluted down to the desired % Fe with additional carrier fluid as desired. Displaced dispersing means may be removed as desired, or allowed to remain within the finished product, depending upon the application.

In the method of the second aspect of the invention, the supply of iron to the trap in accordance with the method of the first aspect is augmented by operating the engine and/or the trap in a manner effective to cause or permit the combustion, at least periodically, of at least some of the soot particles collected in the trap.

It is understood in the art that the practical effect of fuel borne catalysts (such as iron) in catalysing the trap regeneration process is controlled partly by the nature of the catalyst, and partly by engine and/or trap operating conditions. Thus, the supply of iron to the trap in a form suitable for promoting trap regeneration is a first step, whereby the catalytic iron species are positioned in the trap in association with the carbonaceous particulate to be burned, thus creating the starting combination of reactant and catalyst necessary to permit the ignition temperature-reducing activity of the catalyst to take practical effect. However, to effect regeneration, this starting combination must also be supplied with oxidising gas(es) and a temperature regime within the trap sufficient to provide the necessary thermal energy to activate the ignition of the carbonaceous particulate, albeit at a lower temperature than would otherwise by required in the absence of the iron catalyst.

The provision of oxidising gas(es) is typically effected by the natural passage of the diesel engine exhaust gases through the trap. Diesel engine exhaust in particular contains excess oxygen as a result of the lean air:fuel stoichiometry on which the diesel engine functions. Thus, unreacted oxygen is present in the exhaust gas and flows over the trap surfaces in its normal course down the exhaust system, so contacting the collected particulate and catalyst and providing the oxidising agent.

The thermal energy necessary to provide the activation energy needed to permit the catalyst-induced ignition of the carbonaceous particulate is typically provided by the temperature of the exhaust gas within the trap.

For an engine operating under variable road conditions, this exhaust gas temperature can vary between approximately 200° C. (in low speed, urban traffic) and above 500° C. (in high speed, high load driving, e.g. on autobahns or motorways). Consequently, without artificial control or supplementation, the temperature inside the trap fluctuates in line with vehicle operation, and will periodically exceed the temperature required to permit the combustion of the carbonaceous particulate at a given catalyst concentration. Periodic or "stochastic" regeneration results, in which particulate matter in the trap is burned off during peaks of sufficient exhaust temperature, but accumulates during the lower temperature periods.

Stochastic generation can provide sufficient regeneration for certain engine operating needs. However, particularly for engines on city driving duties with lower exhaust temperature operating regimes, spontaneous stochastic regeneration may be infrequent. To take account of this, regeneration under the method of the second aspect of the invention may be augmented where necessary by artificial means of increasing exhaust gas temperatures such as trap heaters (to locally raise trap temperatures) or by post-injection of fuel, in which small quantities of additional fuel are injected into the combustion chamber or exhaust system after combustion, the more reactive and volatile components of which thereafter 'burn' in the exhaust system (as a result of the excess oxygen in the exhaust gas) and cause a local raising of exhaust gas temperature. As the catalytic effect of iron in the trap ensures that the collected particulate ignites at lower temperatures, such means may be deployed more efficiently than in the absence of the iron catalyst. The management of such artificial aids to regeneration is preferably done by the on board management system of the vehicle, and can be designed into the vehicle at production stage for a given concentration of iron colloid in the fuel, or added in a "retrofit" assembly to adapt older vehicles previously unequipped with such systems.

Typically, such management systems comprise one or more sensors monitoring trap temperature, back-pressure across the trap (proportional to the degree of particulate accumulation therein) or both. These sensors feed this information to a microprocessor which determines the instantaneous need for raising of exhaust gas temperatures by artificial means, and activates the means fitted to the vehicle to the required degree. In this way, the effect of the catalyst is optimised to provide the preferred frequency and severity of regeneration within the trap.

Under higher exhaust temperature operating conditions, the provision of iron to the trap in accordance with the method of the first aspect can lead to stochastic or even true continuous regeneration whereby particulate matter is continually burned off as it accumulates on the trap.

Thus, in a preferred embodiment of the second aspect, the invention provides a method of regenerating a particulate trap fitted to the exhaust system of a diesel engine-powered device, comprising i) the supply of iron to the trap in accordance with the method of any preceding claim, and ii) operating the engine or the trap in a manner effective to cause or permit the combustion, at least periodically, of at least some of the carbonaceous particulate collected in the trap, wherein, in step ii), the trap is at least periodically either exposed to exhaust gas temperatures sufficient to permit the combustion of at least some carbonaceous particulate collected therein, or heated to a temperature sufficient to cause the combustion of at least some carbonaceous particulate collected therein.

The means by which traps may be heated during operation of the engine is known to the person skilled in the art. However, illustrative of such means are those described in SAE paper No. 970470 entitled "Applications for the Regeneration of Diesel Particulate Traps by Combining Different Regeneration Systems" by Luders, Stommel and Backes. In particular, this paper describes (on pages 132 to 134) the use of suitable electric heater or diesel fuel burner systems, which can augment the regeneration effect of the catalyst at low exhaust gas temperatures, and thus bring more flexibility to the trap regeneration regime(s) adopted on a specific vehicle.

EXAMPLES

The present invention in its various aspects is hereafter illustrated by the following examples.

Preparative Examples

P1—Example preparations of the colloids of crystalline iron oxide

P2—Preparation of further examples and comparative examples

Working Examples

W1—measurement of the crystallinity of iron-based additives by X-Ray diffraction:

a) X-Ray diffraction test protocol b) comparisons of the crystallinity of iron-based additives W2—effect of carboxylic acid:iron ratio on colloid viscosity and fuel stability W3—injector fouling examples:

a) injector fouling tests—engine test protocol b) effect of colloid dispersing means and iron form on injector fouling performance

Example P1

General Preparation of the Colloids of the Invention

Example P1(a)

Preparation of a Colloid of Crystalline Iron Oxide

A first colloidal nanodispersion of crystalline iron oxide in oleic acid (the 'stock dispersion') was prepared. This stock dispersion comprised 30% Fe (by weight, per weight of colloid) and 11% weight of oleic acid, dispersed in Isopar-L as carrier fluid. This stock dispersion was subsequently used for a series of incorporation reactions to form the series of colloids of the invention recited in subsequent examples. The iron oxide core consisted of a mixture of magnetite and a minor proportion of goethite.

The weight ratio of acid:iron within the stock dispersion was 11:30, i.e. 1:2.7.

In a second stage of the preparation, the above stock dispersion was further reacted with a series of chosen carboxylic reactants in the incorporation reaction.

The reaction is exemplified by the following, used to prepare colloid example number 7 below. 650.0 g of the oleic acid-iron oxide stock dispersion (30% w/w Fe, dispersed in Isopar-L solvent) was charged into a 2 liter Parr reactor along with 250.0 g of "Glissopal SA" polyisobutylene succinic anhydride (containing 78% active ingredient in diluent, the polyisobutylene having a number average molecular weight of approximately 1000) and 3.49 g of deionised water to effect in situ hydrolysis of the anhydride group to dicarboxylic acid.

The charging ratio of dicarboxylic acid:iron (weight:weight) was thus effectively 1:1, i.e. 195 g of polyisobutylene succinic anhydride (78% of 250 g): 195 g of iron (30% of 650 g). When using other carboxylic acids to displace the oleic acid, the required amount of acid can be calculated analogously, based on the desired ratio of acid:iron in the resulting colloid, and the active ingredient level of the carboxylic acid product used.

The reactor was then purged with nitrogen gas and sealed at atmospheric pressure. The reactor was heated with stirring at 4000 rpm to 140° C. Upon reaching the desired temperature, the stirring under temperature was continued for a further 3 hours. During the process the pressure within the reactor was noted to reach a maximum of 14 psi. After 3 hours, the temperature of the reaction mixture was decreased (using a cooling water coil) and the colloid product drained from the reactor once it had cooled below 30° C.

The resulting product contained the desired colloid, in which the polyisobutylene succinic acid had incorporated into the colloid as dispersing means. Any displaced oleic acid from the stock dispersion remained in the product, and thus final weight ratio of acid:iron in the product was 1.4:1.

The concentrated stabilised colloid prepared as above may be diluted down to the desired % Fe level with additional carrier fluid.

Example P1(b)

Preparation of a Colloid of Amorphous Iron Oxide

This material was prepared using the following three-stage method, analogous to that used in WO-A-2003/053560 to prepare its amorphous iron colloids, but adapted to employ the dispersing means of the present invention, filtration as a separation method instead of the centrifugation used in therein, and the use of acetone to facilitate the production of a dry powdered iron hydroxide phase.

Stage 1: Iron Acetate Solution Preparation

Iron nitrate nonahydrate ($[Fe(NO_3)_3.9H_2O]$, 251 g, 0.621 mole) dissolved in demineralised water (1100 ml) was placed in a 2 liter beaker equipped with a large magnetic stirring bar. The initial pH of the orange solution was ~0.9, Aqueous ammonium hydroxide solution (10 M, ~400 ml) was added drop wise over 1.5-2 hours to the stirred mixture at room temperature to give a final pH of 7. On addition of the base, the solution changed to a viscous brick-red suspension. The mixture was stirred at room temperature for an additional 1 hour.

The mixture was then filtered, and the precipitate collected transferred to a 2 liter beaker and stirred with demineralised water (~1400 ml) for 10 minutes. The mixture was filtered and this washing procedure was repeated once more. Finally, the filtered and washed precipitate was transferred to a 2 liter beaker and demineralised water (1400 ml) added. Glacial acetic acid (105 ml, 1.83 moles) was added to the stirred mixture. The mixture was left stirring overnight at room temperature to give a red-black solution, free of sediment to use in the next stage.

Stage 2: Iron Hydroxide Preparation

The iron acetate solution from Stage 1 and aqueous ammonium hydroxide solution (10 M) were each added separately drop wise to stirred demineralised water (1 liter) in a 3 liter beaker. The iron acetate solution had a pH of 3.5. The flow rate of the iron acetate solution was fixed and the flow rate of the ammonium hydroxide solution was adjusted to keep the pH of the well-stirred mixture at a constant pH 8 (pH electrode used).

After about 2 hours, ~700 ml of iron acetate solution and 193 ml of ammonium hydroxide solution had been added. The red-brown slurry that formed was stirred for an additional 30 minutes before filtration to give 253 g of a brick-red/brown precipitate containing ~80% water. The wet precipitate was washed thoroughly with acetone and then air-dried on the filter to give a brown powder typically containing ~40% Fe (measured by ICP-AE) which was used directly in the next stage.

Stage 3: Preparation of Colloidal Amorphous Iron Oxide Derivative

A portion of the brown precipitate from Stage 2 was dispersed in Isopar-L containing the same polyisobutylene succinic anhydride as used in Example P1(a) ("Glissopal SA" polyisobutylene succinic anhydride, containing 78% active ingredient in diluent, the polyisobutlyene having a number average molecular weight of approximately 1000) in an amount equal in weight to the weight of iron in the preparation (i.e. an acid:iron ratio of 1:1), and one equivalent of water to effect in situ hydrolysis of the anhydride ring. The reaction mixture was heated under nitrogen with stirring at 90° C. for at least 5½ hours before cooling to room temperature. The mixture was filtered to remove insolubles and analysed for Fe content, and used directly. Excess water was removed from the product solution by azeotropic distillation.

Example P2

Preparation of Further Examples and Comparative Examples

Further Examples of Colloids of Crystalline Iron Oxide, and Comparative Examples Using the above-exemplified two-step method, a series of crystalline colloid examples 1 to 8 were prepared. In each case, the same stock dispersion starting material (see example P1(a) above) was employed, but the dispersing means was varied.

The series of colloids was prepared using dicarboxylic reactant, in which the weight ratio of dicarboxylic acid used in the second stage of the preparation:iron used was 1:1, and a range of different alkenyl succinic acids were employed. The resulting colloids had the acid constituents and iron contents (in percent weight) shown in the table below. In each preparation, the anhydride was used as the diacid precursor and water added to the reaction mixture to facilitate in situ hydrolysis of the anhydride group.

In these examples, the dispersing means in the colloid consisted of a proportion of residual oleic acid (remaining from the starting material) and the mono- or di-carboxylic acid incorporated during stage two of the preparation. The overall ratio of carboxylic acid:iron in the product was therefore in excess of that ratio of acid added in stage 2 by a value of about 0.4. Thus a ratio of 1:1 was used in the examples below in stage two, with the final ratio in each colloid product being about 1.4:1.

A series of comparative colloids (examples 1C to 5C) was prepared using monocarboxylic acid reactant, in each of which the weight ratio of monocarboxylic acid used in the second stage of the preparation:iron was 1:1, and the acids decanoic, neodecanoic, oleic, stearic, isostearic and behenic respectively were employed. The resulting colloids had the iron contents (in percent weight) shown in the table below.

Note: 1) in the table below, the nomenclature "Polyisobutylene$_x$SA ($C_y$, branched)" means a polyisobutylene succinic acid of number average molecular weight 'x' (as measured by GPC, against polystyrene standards), which number average molecular weight corresponds to an average carbon number y. 2) "Comp" means comparative example.

Examples of Crystalline Colloids 1 to 8, and Comparative Colloids 1C to 5C

| Colloid | Example Number | Carboxylic acid used during colloid preparation | Colloid Fe content (% weight) |
|---|---|---|---|
| Alkenyl succinic acid preparations | 1 | Dodecenyl succinic acid ($C_{12}$, branched) | 26.4 |
| | 2 | Hexadecenyl succinic acid ($C_{16}$, branched) | 28.4 |
| | 3 | Octadecenyl succinic acid ($C_{18}$, branched) | 27.4 |
| | 4 | Polyisobutylene$_{450}$SA ($C_{32}$, branched) | 25.28 |
| | 5 | Polyisobutylene$_{700}$SA ($C_{49}$, branched) | 25.66 |
| | 6 | Polyisobutylene$_{950}$SA ($C_{67}$, branched) | 27.16 |
| | 7 | Polyisobutylene$_{1000}$SA ($C_{70}$, branched) | 24.96 |
| | 8 | Polyisobutylene$_{2300}$SA ($C_{161}$, branched) | 25.0 |
| Monocarboxylic acid preparations | 1C | Decanoic Acid ($C_{10}$, linear) | 26.26 |
| | 2C | Neodecanoic Acid ($C_{10}$, branched) | 25.4 |
| | 3C | Stearic Acid ($C_{18}$, linear) | 26.41 |
| | 4C | Isostearic Acid ($C_{18}$, branched) | 25.3 |
| | 5C | Behenic Acid ($C_{22}$, linear) | 13.57 |

Further Examples of Colloids of Amorphous Iron Oxide, and Comparative Examples Using the above-exemplified three-stage method adapted from WO-A-2003/053560 (see example P1(b) above), a series of amorphous colloid examples 9 to 16 were prepared. A series of comparative amorphous colloid examples dispersed by various monocarboxylic acids were also prepared.

The series of colloids (having an acid:iron ratio of 1:1) prepared according to this method are shown in the table below.

Examples of Amorphous Colloids 9 to 16, and Comparative Colloids 6C to 10C

| Colloid | Example Number | Carboxylic acid used during colloid preparation | Colloid Fe content (% weight) |
|---|---|---|---|
| Alkenyl succinic acid preparations | 9 | Dodecenyl succinic acid ($C_{12}$, branched) | 2.75 |
| | 10 | Hexadecenyl succinic acid ($C_{16}$, branched) | 2.40 |
| | 11 | Octadecenyl succinic acid ($C_{18}$, branched) | 1.80 |
| | 12 | Polyisobutylene$_{450}$SA ($C_{32}$, branched) | 1.40 |
| | 13 | Polyisobutylene$_{700}$SA ($C_{49}$, branched) | 2.29 |
| | 14 | Polyisobutylene$_{950}$SA ($C_{67}$, branched) | 2.37 |
| | 15 | Polyisobutylene$_{1000}$SA ($C_{70}$, branched) | 3.51 |
| | 16 | Polyisobutylene$_{2300}$SA ($C_{161}$, branched) | 2.36 |
| Monocarboxylic | 6C | Decanoic Acid ($C_{10}$, linear) | 2.59 |

-continued

| Colloid | Example Number | Carboxylic acid used during colloid preparation | Colloid Fe content (% weight) |
|---|---|---|---|
| acid preparations | 7C | Neodecanoic Acid ($C_{10}$, branched) | 3.16 |
| | 8C | Stearic Acid ($C_{18}$, linear) | 2.67 |
| | 9C | Isostearic Acid ($C_{18}$, branched) | 3.63 |
| | 10C | Oleic Acid ($C_{18}$, unsaturated) | 4.18 |

It is notable that the amorphous colloids showed much lower iron contents than the crystalline colloids. In the subsequent experimental work, this was accounted for by normalising the performance of the test colloid against iron content.

Further Examples of the Invention

Having Differing Acid:Iron Ratios

A second series of crystalline colloid examples 17 to 21 were prepared, using the above method and dicarboxylic acid used in example P1(a), but varying the ratio of dicarboxylic acid:iron used in the preparations, to permit investigation of the effect of this ratio. This series is detailed in the table below.

| Colloid | Example Number | Dicarboxylic acid used during preparation (stage 2) | Colloid Fe content (% weight) | Ratio of diacid:Fe used in preparation | Overall ratio of diacid:Fe in product |
|---|---|---|---|---|---|
| Alkenyl succinic acid preparations | 17 | Polyisobutylene$_{950}$SA | 18 | 2:1 | 2.4:1 |
| | 18 | Polyisobutylene$_{950}$SA | 24 | 1:1 | 1.4:1 |
| | 19 | Polyisobutylene$_{950}$SA | 25 | 1:1.3 | 1.14:1 |
| | 20 | Polyisobutylene$_{950}$SA | 29 | 1:2 | 1:1.14 |
| | 21 | Polyisobutylene$_{950}$SA | 30 | 1:4 | 1:1.6 |

Example W1

Measurement of the Crystallinity of Iron-Based Additives by X-Ray Diffraction a) X-Ray Diffraction Test Protocol Crystallinity as defined in the present specification and claims is measured by means of X-Ray Diffraction. The core is crystalline if, under X-Ray diffraction of the colloid, one or more sharp peaks are observed which are attributable to the existence of a defined crystal structure or lattice within its core. This determination can be achieved by conducting the X-Ray diffraction according to the following protocol, and thereafter comparing the diffraction pattern received with library patterns for different iron oxide crystalline forms.

The protocol used for X-Ray diffraction of the colloid was firstly to prepare the sample for scanning by applying the relevant colloid sample directly onto a silicon low background substrate, and allowing the sample to dry. The sample formed a viscous tacky film which could then be investigated. X-Ray diffraction data was collected from 2-70 degrees 2 theta on a Philips PW1800 automatic powder X-ray diffractometer using Copper K alpha radiation generated at 40 kV and 55 mA, and a 4 second per point count time.

b) Comparison of the Crystallinity of Iron-Based Additives

Using the above protocol, X-Ray diffraction studies were performed on two example colloids of the present invention (example 6 and example 14), the stock dispersion used in preparation of example 6 (see example P1(a) above), the additive Eolys® 176 used in the preparation of Example 9 of EP-A-1 512 736 cited earlier, and a commercially available iron colloid identified as "DPX-10" and sold for trap regeneration usage.

The results are presented in FIGS. 1 to 5 respectively.

Figure 2:
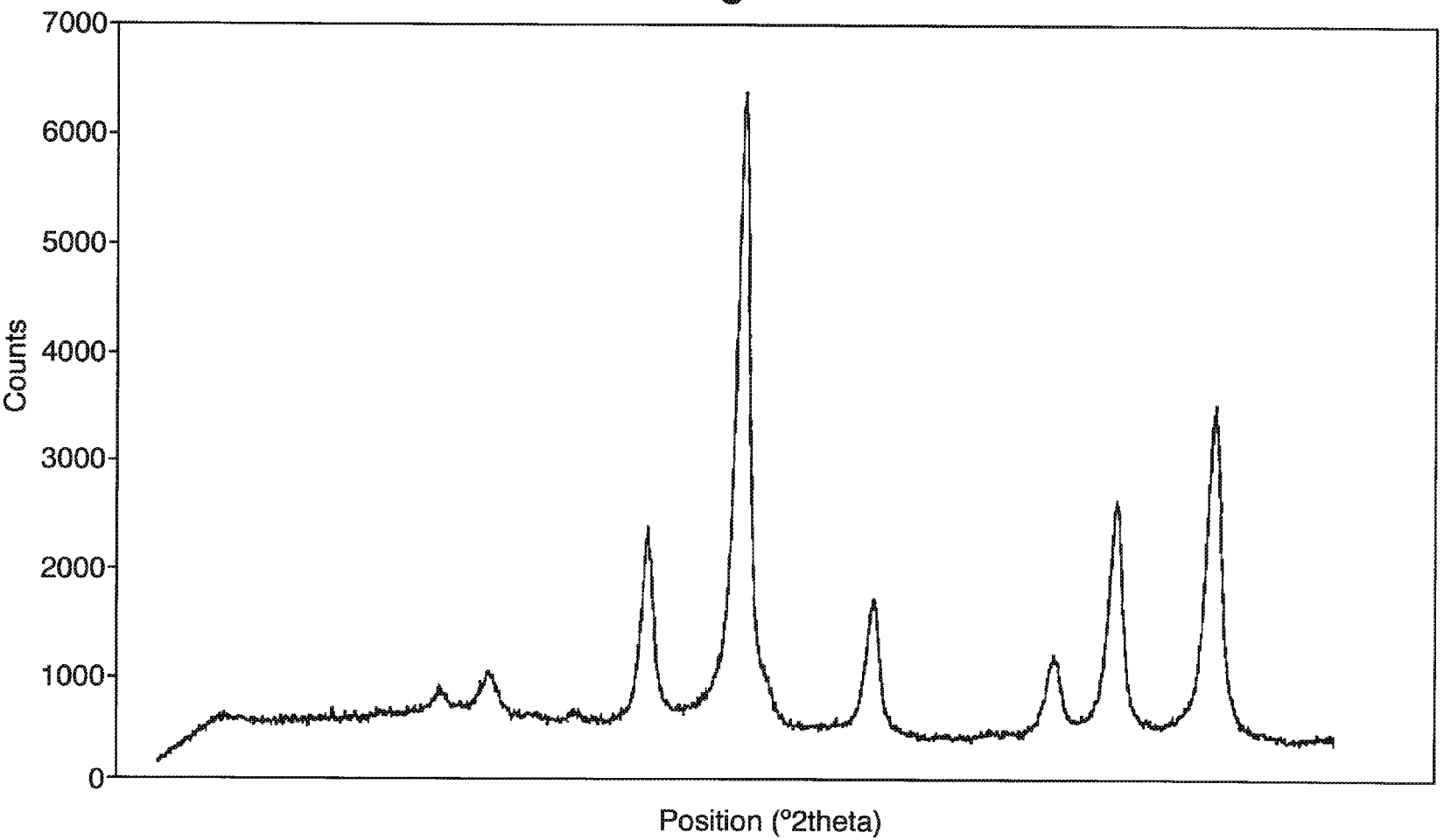

FIGS. 1 and 2 relate to example 6 and its stock dispersion respectively. In each of these figures a series of sharp peaks is apparent, which have been assigned predominantly to the magnetite ($Fe_3O_4$) crystal form of iron oxide. The results confirm both that the iron oxide core of this colloid example is crystalline, and that the process by which this colloid is made (Example P1(a)) preserves the crystallinity present in the iron-based starting material.

In contrast, the patterns for example 14 (made by the process exemplified in P1(b)—FIG. 3), Eolys® 176 (FIG. 4) and DPX-10 (FIG. 5) show an absence of sharp peaks and cannot be attributed a crystalline iron oxide structure. Such materials are amorphous in character.

Using the same X-Ray diffraction protocol, the colloids of the invention and the comparative materials made in Example P2 above were characterised as crystalline or amorphous. The results were as follows:

Colloid characterisation by X-Ray Diffraction

| Colloid | Characterisation: Example Number | Characterisation: Characterisation by X-RayDiffraction |
|---|---|---|
| Monocarboxylic acid preparations (comparative) | 1C | Crystalline |
| | 2C | Crystalline |
| | 3C | Crystalline |
| | 4C | Crystalline |
| | 5C | Crystalline |
| | 6C | Amorphous |
| | 7C | Amorphous |
| | 8C | Amorphous |
| | 9C | Amorphous |
| | 10C | Amorphous |
| Alkenyl succinic acid preparations | 1 | Crystalline |
| | 2 | Crystalline |
| | 3 | Crystalline |
| | 4 | Crystalline |
| | 5 | Crystalline |
| | 6 | Crystalline |
| | 7 | Crystalline |
| | 8 | crystalline |
| | 9 | Amorphous |
| | 10 | Amorphous |
| | 11 | Amorphous |
| | 12 | Amorphous |
| | 13 | Amorphous |
| | 14 | Amorphous |

-continued

| Colloid characterisation by X-Ray Diffraction | | |
|---|---|---|
| | Characterisation | |
| Colloid | Example Number | Characterisation by X-RayDiffraction |
| | 15 | Amorphous |
| | 16 | Amorphous |

The X-Ray diffraction results also confirm that all the colloid examples made by the process of Example P1(a) have a crystalline iron oxide core, whilst all the colloids made by the process of Example P1(b) have an amorphous core.

Example W2

Effect of Carboxylic Acid:Iron Ratio on Colloid Viscosity and Fuel Stability The series of crystalline colloids prepared as examples 17 to 21 above, and having different ratios of dicarboxylic acid: iron present therein, were used to investigate the effect of varying the carboxylic acid:iron weight ratio on relevant physical properties. The colloids differed in percentage iron content as a result of the different ratios used, i.e. the lower ratios contained higher proportions of iron.

Each resulting colloid was analysed for its iron content (in % wt of colloid) and tested for its kinematic viscosity and its stability in fuel, measured using the following techniques:

Kinematic viscosity—measurement of viscosity according to the test procedure ASTM D-445 (entitled 'Standard Test Method for Kinematic Viscosity of Transparent and Opaque Liquids (and calculation of Dynamic Viscosity'). In summary, this standard method measures the time for a volume of liquid to flow under gravity through a calibrated glass capillary viscometer.

Stability in fuel—visual observation during static storage at 80° C. of a Class I diesel fuel containing 75 ppm (by weight, per weight of fuel) of the colloid reaction product. In this test, the appearance of haze or precipitate in the fuel sample over time indicates instability (failure).

The viscosity results clearly indicate the lower viscosities provided by colloids with lower ratios of acid:iron. In particular, a large decrease in viscosity was seen between the 2.4:1 and 1.4:1 colloid examples. The examples within the ratio range of 1.5:1 to 1:2 showed the lowest viscosity behaviour and additionally offered the highest iron concentrations, making them particularly suitable for on board vehicle applications wherein high iron concentration, low viscosity additives are most advantageous.

Test Colloids and Resulting Kinematic Viscosity

| Colloid example | Overall weight ratio of diacid:iron | Iron in colloid (% wt) | Kinematic viscosity at temperature shown, as measured by ASTM D-445 (cSt) −20° C. | −10° C. | 0° C. | 20° C. | 40° C. |
|---|---|---|---|---|---|---|---|
| 17 | 2.4:1 | 18 | 21250 | 7919 | 3346 | 790 | 257 |
| 18 | 1.4:1 | 24 | 2831 | 1270 | 634 | 208 | 88 |
| 19 | 1.14:1 | 25 | 1736 | 813 | 444 | 152 | 65 |
| 20 | 1:1.14 | 29 | 652 | 340 | 198 | 79 | 39 |
| 21 | 1:1.6 | 30 | 273 | 154 | 95 | 44 | 24 |

These viscosity benefits are preserved when translated into a series of more dilute colloids wherein the iron content has been equalised at 10% wt. Moreover, these colloids show significant viscosity advantages over concentrates of the commercially available iron salt 'iron neodecanoate', even when the latter is used at lower iron contents in the same solvent carrier. Thus, by employing the colloid of the invention, more concentrated additives with lower, more advantageous viscosities can be prepared than were available hitherto.

As can be seen in the table below, iron neodecanoate at an iron concentrate level of only 6% produced viscosities far in excess of that provided by any of the colloids of the invention containing iron at the higher concentration of 10%. It was necessary to dilute the iron neodecanoate to a level as low as 4 wt % (iron) to prepare a concentrate having superior viscosity to the worst performing colloid of the invention (only). Given that trap regeneration additives are typically used at a target iron level in the fuel, this difference in usable iron concentration permits the use of lower volumes of additive to meet the fuel iron concentration target. In on board applications, this permits an existing additive tank carrying a given volume of additive to treat more fuel, and so reduces vehicle service requirements.-

Kinematic Viscosity of Test Colloids at Constant Iron Content

| Colloid example | Overall weight ratio of diacid:iron | Iron in dilute colloid (% wt) | Kinematic viscosity at temperature shown, as measured by ASTM D-445 (cSt) −20° C. | −10° C. | 0° C. | 20° C. | 40° C. |
|---|---|---|---|---|---|---|---|
| 15 | 2.4:1 | 10 | 83 | 48 | 32 | 15 | 9 |
| 16 | 1.4:1 | 10 | 18 | 12 | 9 | 5 | 4 |
| 17 | 1.14:1 | 10 | 15 | 10 | 7 | 4 | 3 |
| 18 | 1:1.14 | 10 | 10 | 7 | 5 | 3 | 2 |
| 19 | 1:1.6 | 10 | 8 | 6 | 5 | 3 | 2 |
| Iron neodecanoate in concentrate form | | 6 | 483 | 219 | 103 | 35 | 14 |
| | | 4 | 43 | 25 | 15 | 7 | 4 |

Fuel Stability Results

The fuel stability tests on the above iron colloids demonstrated that the colloids wherein the ratio of acid:iron was 2.4:1 and 1.4:1 were still stable after 33 days storage, at which time the test was discontinued. The colloids having the 1.14:1 ratio showed signs of instability after 19 days, and the colloid having the 1:1.6 ratio showed signs of instability after 26 days.

Further stability tests were conducted in the presence of 150 ppm of a lubricity additive known to destabilise metallic additives, namely an ethoxylated tall oil fatty acid dimer. In these tests, the 2.4:1 and 1.4:1 colloids were partly destabilised by the addition of the additional additive, instability being observed after 19 days, although this degree of stability still represented good performance in an absolute sense. However, the other colloids were not significantly destabilised, indicating that colloids with lower ratios are particularly useful when fuel stability is required in the presence of that class of lubricity additives.

Example W3

Injector Fouling Examples a) Injector Fouling Tests—Engine Test Protocol

The injector fouling tendencies of various materials were compared using the above mentioned test method published at the TAE symposium on 12 and 13 Jan. 2005 under the title "Injector Deposit Test For Modern Diesel Engines". In this test, the torque produced by the engine at specified running conditions is monitored, and the resulting difference in torque measured over the test used as a indicator of the build-up of adverse deposits on the fuel injectors.

In detail, the engine test protocol is as follows.

A modern high speed passenger car diesel engine (in these tests, a DW10 2.0 liter Peugeot engine) was installed on a dynamic test bed to enable exact control of the engine conditions. The thermostat of the test engine was blocked open and the coolant circuit connected to the test bed cooling system enabling control of the coolant outlet temperature to 93° C. Also controlled by the automation system were the fuel temperature after the fuel filter (25° C.±0.2° C.) as well as the maximum intake manifold air temperature (50° C.). An application & measurement system to vary injection parameters during the iso-speed measurements and record injection parameters during the test was present. The engine was also equipped with a cylinder pressure sensor to measure cylinder peak pressures during the iso-speed measurements.

To prevent carry over effects, the fuel system was drained and flushed with the new test fuel before a new set of injectors was installed. After the installation of the injectors the engine was started and warmed up before oil was weighed and an oil top up is carried out if necessary.

The test protocol uses severe conditions that induce thermal stress at the fuel injector tip, and driving conditions typical of every day use. A cool down period is also included. The protocol is split into five parts:

a) Iso-speed measurement of engine power output-start
b) 8 hours endurance run
c) 8 hours soaking period (stop of engine for cool down)
d) 8 hours endurance run
e) Iso-speed measurement of engine power output-end At the beginning of the test (a) the engine torque (and hence power output) is measured to define a starting level. Likewise, the engine torque (and hence power output) is measured at the end of the test (e) to measure the final level. These iso-speed measurements are conducted at 4000 rpm and full load, using the application and measurement system to vary specific injection parameters. During the measurement the start of injection (SOI in degree crank angle before top dead centre) and rail pressure are kept constant, whilst the target amount of fuel per stroke is varied stepwise up to 10 mg/stroke around the base setting. This target fuel quantity corresponds to the real injected quantity in case of a deposit free nozzle hole and outlet. In turn, the measured fuel per stroke is lower than the target amount if deposit has built up in the fuel pathway causing a hydraulic flow loss as a consequence. This also impacts on the measured torque, smoke and emission values. In the described iso-speed procedure, the variation of the injected fuel quantity starts 5 mg/stroke below the basic setting for full load and is raised in steps of 1 mg/stroke until one of the following criteria is obtained: 1) the cylinder peak pressure reaches the design limit of the engine, 2) the FSN smoke number reaches a value of 3, or the exhaust gas temperature before the turbine exceeds the design limit of the turbocharger.

The iso-speed measurement in (a) is followed by an 8 hour endurance run (b) to develop a first level of deposit build-up at the injector nozzle. The pattern of this endurance run is shown in the Table below and consists of 12 speed/load points, over a duration of one hour, which cycle is run 8 times.

TABLE

Endurance part of the cycle. Cycle A-L repeated 8 times.

| Operating point | N [% Nnom] | Torque M [%] | Stop period [sec] | Ramp [sec] | Endpoint |
|---|---|---|---|---|---|
| A | N2 = 43.75% Nnom | 20 | 105 | 15 | B |
| B | N4 = 75% Nnom | 60 | 405 | 15 | C |
| C | N2 = 43.75% Nnom | 20 | 105 | 15 | D |

TABLE-continued

Endurance part of the cycle. Cycle A-L repeated 8 times.

| Operating point | N [% Nnom] | Torque M [%] | Stop period [sec] | Ramp [sec] | Endpoint |
|---|---|---|---|---|---|
| D | N5 = 87.5% Nnom | 80 | 405 | 15 | E |
| E | N2 = 43.75% Nnom | 20 | 105 | 15 | F |
| F | N6 = Nnom | 100 | 585 | 15 | G |
| G | N1 = 31.25 Nnom | 10 | 105 | 15 | H |
| H | N4 = 75% Nnom | 100 | 405 | 15 | I |
| I | N1 = 31.25% Nnom | 10 | 105 | 15 | J |
| J | N3 = 50% Nnom | 100 | 585 | 15 | K |
| K | N1 = 31.25% Nnom | 10 | 105 | 15 | L |
| L | N6 = Nnom | 100 | 405 | 15 | A |

The engine is thereafter stopped for a cool down period (c) of 8 hours. After this period, the engine has to be run for further 8 hours in a second endurance run (d), using the same cycle as in (b). Following stage (d), the engine torque (and power output) is again measured, to define a finishing level. The measured loss of torque between the start and the end of the test ("delta torque") is used to describe the coking propensity of the nozzle used.

After the test the injectors are disassembled for further inspection. Care has to be taken not to damage the deposits during handling, e.g. the use of protective caps. The standard injector inspection consists of the photographic documentation (microscope with digital camera) of the external deposits around the single nozzle outlets, the possible rating of these deposits and the possible measurement of the hydraulic flow loss to confirm the direct link between loss in torque and injector deposits.

b) Engine Test Results

Using the above protocol, two examples of the invention, namely examples 6 and 14, were compared in a common test fuel with two comparative examples 2C and 7C, and an existing commercial iron salt product (iron neodecanoate). The salient features of the examples are shown in the table below. The treat rate of each product is reported in ppm of elemental iron by weight, per weight of test fuel.

From the results, it can be seen that the examples of the invention (6 and 14) showed little or no loss in torque over the course of the test. In contrast, at the same fuel iron content, the colloids made from neodecanoic acid showed a significant decrease in torque, indicating the build up of adverse deposits over the course of the test (negative delta torque). The salt iron neodecanoate also showed a significant loss in torque over the course of the test.

| Example | X-Ray result | Dispersing means within colloid | Treat rate in test fuel (ppm Fe, w/w) | Delta torque over engine test (%) |
|---|---|---|---|---|
| 6 | crystalline | mixture of oleic acid and polyisobutylene succinic acid* | 6 | 0 |
| 14 | amorphous | polyisobutylene succinic acid* | 6 | −0.4 |
| 2C | crystalline | mixture of neodecanoic acid and oleic acid | 6 | −4.9 |
| 7C | amorphous | neodecanoic acid | 6 | −13.1 |
| Iron neodecanoate (iron salt solution) | | | 6 | −15.3 |

*Polyisobutylene$_{950}$SA ($C_{67}$, branched)

Thus, the colloid of the invention provided (at the same fuel iron concentration) a means for supplying iron via the fuel to the trap not associated with the build-up of adverse deposits, in contrast to other iron colloids differing in dispersing means, and to an existing iron salt additive.

The results (examples 6v. 2C, and examples 14v. 7C) in particular indicate that the nature of the dispersing means impacts on the degree of injector fouling observed. The combination of crystalline iron oxide core, and dispersing means consisting of a mixture of polyisobutenyl-substituted succinic acid and oleic acid gave particularly good results.

The invention claimed is:

1. A method of supplying iron to a particulate trap of a diesel engine exhaust in a form suitable for promoting trap regeneration, the method comprising the following steps:

a. adding a particulate trap regenerating additive comprising a colloid consisting of iron oxide particles dispersed in a carrier fluid, dispersing means within the colloid being one or more carboxylic acid compounds to a diesel fuel, in an amount which provides an iron concentration within the fuel sufficient to promote trap regeneration of a particulate trap, wherein the iron oxide in the particulate trap regenerating additive is the only oxide added to the diesel fuel;

b. combusting the diesel fuel composition resulting from step a. in a diesel engine equipped with a particulate trap in its exhaust system; and c. within the particulate trap, thereafter collecting iron-containing compounds resulting from combustion, in association with at least some of carbonaceous particulate matter emitted by the engine;

wherein said carboxylic acid compounds include at least one hydrocarbyl-substituted dicarboxylic acid containing between 8 and 200 carbon atoms, and wherein any additional carboxylic acid compounds within the colloid are either hydrocarbyl-substituted dicarboxylic acids containing between 8 and 200 carbon atoms, or aliphatic monocarboxylic acids containing between 8 and 20 carbon atoms, or mixtures thereof; and wherein the weight ratio of carboxylic acid(s) to iron in the colloid (measured as the total weight of acid compound(s) to weight of elemental iron contained within the iron oxide particles) is in the range of from about 1.5:1 to about 1:2.

2. The method of claim 1, wherein the iron is supplied to the particulate trap without an associated increase in adverse deposits on one or more fuel injectors of a diesel engine.

3. The method of claim 1, wherein said diesel engine is an engine which exhibits loss of engine performance due to the formation of fuel injector deposits associated with the presence of organic metal salts in the fuel, as determined by a reduction in engine torque when the engine is run at constant operating conditions on a fuel containing one or more organic zinc salts in an amount sufficient to provide at least 1 part-per million (by weight, per weight of fuel) of elemental zinc to the fuel.

4. The method of claim 1 wherein the iron oxide particles within the colloid consist essentially of crystalline form(s) of iron oxide.

5. The method of claim 4 wherein the dispersing means within the colloid consists of one or more hydrocarbyl-substituted dicarboxylic acid containing between 8 and 200 carbon atoms.

6. The method of claim 5, wherein the, or each, dicarboxylic acid is a hydrocarbyl-substituted succinic acid.

7. The method of claim 1 wherein the dispersing means within the colloid consists of one or more hydrocarbyl-substituted dicarboxylic acids containing between 8 and 200 carbon atoms in combination with one or more monocarboxylic acid containing between 8 and 20 carbon atoms.

8. The method of claim 7, wherein said dispersing means consists of one or more aliphatic-substituted succinic acids in combination with one or more aliphatic monocarboxylic acids acid containing between 10 and 18 carbon atoms.

9. The method of claim 8 wherein said dispersing means within the colloid comprises oleic acid and polyisobutenyl succinic acid; the polyisobutenyl group of which has a number average molecular weight (as measured by gel permeation chromatography, against polystyrene standards) of between 450 and 2300.

10. The method of claim 1 wherein the weight ratio of carboxylic acid(s) iron in the colloid is in the range of from about 1.4:1 to 1:2.

11. The method of claim 1 wherein the iron-containing compounds resulting from the combustion of the fuel comprises iron oxide(s), are particulate in form, and become entrained within the carbonaceous particulate matter collecting in the trap.

12. The method of claim 1 wherein the iron-containing compounds resulting from combustion of the fuel consist essentially of one or more forms of iron oxide.

13. The method of claim 1 wherein step a is effected on board the device fitted with the diesel engine employed in step b.

14. The method of claim 13, wherein the device is a road vehicle carrying the fuel and the colloid in discrete reservoirs, and wherein step a. is effected by dosing the colloid into the fuel tank or into a vehicle fuel line in the desired amount using a dosing apparatus.

15. The method of claim 14, wherein the operation of the dosing apparatus is controlled by the engine management system on board the vehicle.

16. The method of claim 4 wherein the iron oxide particles within the colloid consist essentially of magnetite.

* * * * *

UNITED STATES PATENT AND TRADEMARK OFFICE

CERTIFICATE OF CORRECTION

PATENT NO. : 8,641,791 B2
APPLICATION NO. : 12/593084
DATED : February 4, 2014
INVENTOR(S) : Russell M. Thompson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 666 days.

Signed and Sealed this
Twenty-second Day of September, 2015

Michelle K. Lee

Michelle K. Lee
*Director of the United States Patent and Trademark Office*